US007113728B2

(12) United States Patent
Owa et al.

(10) Patent No.: US 7,113,728 B2
(45) Date of Patent: Sep. 26, 2006

(54) IMAGE FORMING SYSTEM AND IMAGE FORMING APPARATUS

(75) Inventors: Masahiro Owa, Nagano-ken (JP); Ken Yoshizuka, Nagano-ken (JP); Akira Maruyama, Nagano-ken (JP); Osamu Ishibashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 172 days.

(21) Appl. No.: 10/860,781

(22) Filed: Jun. 3, 2004

(65) Prior Publication Data

US 2005/0041995 A1 Feb. 24, 2005

(30) Foreign Application Priority Data

Jun. 4, 2003 (JP) ..... 2003-160066
Jun. 4, 2003 (JP) ..... 2003-160067

(51) Int. Cl.
*G03G 15/01* (2006.01)

(52) U.S. Cl. ..... 399/223; 399/88; 399/229

(58) Field of Classification Search ..... 399/8, 399/9, 12, 13, 24, 25, 223, 227, 75, 88, 222, 399/224, 225, 228, 229
See application file for complete search history.

(56) References Cited

U.S. PATENT DOCUMENTS 6,493,519 B1 * 12/2002 Sasame et al. ..... 399/25
6,970,262 B1 * 11/2005 Saito ..... 358/1.15

FOREIGN PATENT DOCUMENTS

| | | |
|---|---|---|
| JP | 06-019256 | 1/1994 |
| JP | 2001-083750 | 3/2001 |
| JP | 2002-333756 | 11/2002 |
| JP | 2003-043773 | 2/2003 |
| JP | 2003-114772 | 4/2003 |

* cited by examiner

*Primary Examiner*—Hoan Tran
(74) *Attorney, Agent, or Firm*—Hogan & Hartson LLP

(57) ABSTRACT

An image forming system includes an image forming apparatus with attach/detach sections to/from which a developer container is attachable/detachable and an image bearing body. A driver instructs the apparatus to execute single-color or color-image formation. When a developer container is attached to each attach/detach section, the apparatus is usable as a color image forming apparatus. When a developer container is attached to only one attach/detach section, the apparatus is usable as a single-color image forming apparatus. The apparatus forms an image when the driver instructs the apparatus that is being used as the color image forming apparatus to execute single-color-image formation. The apparatus does not form an image when the driver instructs the apparatus that is being used as the single-color image forming apparatus to execute color-image formation.

19 Claims, 21 Drawing Sheets

| apparatus-type information | information in control signal COM | execution/non-execution of image formation |
|---|---|---|
| color | color | yes |
| color | monochrome | yes |
| mono-chrome | color | no |
| mono-chrome | monochrome | yes |

FIG. 11

| case | attachment information value | | | | setting operation of apparatus-type information |
|---|---|---|---|---|---|
| | black | magenta | cyan | yellow | |
| A | 0 | 0 | 0 | 0 | do not set |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | set "1" (monochrome printer) |
| J | 1 | 0 | 0 | 1 | set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 13

| apparatus-type information | information in control signal COM | execution/non-execution of image formation |
|---|---|---|
| color | color | yes |
| color | monochrome | yes |
| mono-chrome | color | no |
| mono-chrome | monochrome | yes |

FIG. 16

| case | attachment information value | | | | setting operation of apparatus-type information |
|---|---|---|---|---|---|
| | black | magenta | cyan | yellow | |
| A | 0 | 0 | 0 | 0 | do not set |
| B | 0 | 0 | 0 | 1 | |
| C | 0 | 0 | 1 | 0 | |
| D | 0 | 0 | 1 | 1 | |
| E | 0 | 1 | 0 | 0 | |
| F | 0 | 1 | 0 | 1 | |
| G | 0 | 1 | 1 | 0 | |
| H | 0 | 1 | 1 | 1 | |
| I | 1 | 0 | 0 | 0 | set "1" (monochrome printer) |
| J | 1 | 0 | 0 | 1 | set "0" (color printer) |
| K | 1 | 0 | 1 | 0 | |
| L | 1 | 0 | 1 | 1 | |
| M | 1 | 1 | 0 | 0 | |
| N | 1 | 1 | 0 | 1 | |
| P | 1 | 1 | 1 | 0 | |
| Q | 1 | 1 | 1 | 1 | |

FIG. 18

IMAGE FORMING SYSTEM AND IMAGE FORMING APPARATUS

CROSS-REFERENCE TO RELATED APPLICATIONS

The present application claims priority upon Japanese Patent Application No. 2003-160066 filed Jun. 4, 2003 and Japanese Patent Application No. 2003-160067 filed Jun. 4, 2003, the contents of which are herein incorporated by reference.

BACKGROUND OF THE INVENTION

1. Field of the Invention

The present invention relates to image forming systems and image forming apparatuses.

2. Description of the Related Art

There are known image forming systems that comprise, for example: an image forming apparatus including a plurality of attach/detach sections to and from each of which a developing unit (which serves as an example of a developer container for containing developer) can be attached and detached, and an image bearing body for bearing a latent image; and a computer that is capable of communicating with the image forming apparatus and that is provided with a driver capable of instructing execution of image formation to the image forming apparatus. The image forming apparatus of the type described above forms images by developing the latent image bore on the image bearing body with the developer contained in the developing unit(s) attached to the attach/detach section(s). In such image forming systems, when image data are transmitted from the computer in accordance with instructions given by the driver to execute image formation, the image forming apparatus moves the developing units to thereby locate one of them at a developing position opposing the image bearing body. A developer image is formed by developing the latent image formed on the image bearing body, and the image is temporarily transferred onto an intermediate transferring body. The developer image formed on the intermediate transferring body is then transferred onto a medium to form an image thereon. (See, for example, Japanese Patent Application Laid-open Publication No. 2002-333756. )

In some situations, a user may wish to use a color image forming apparatus as a monochrome image forming apparatus by attaching, for example, only a black developing unit, which contains black developer, to the image forming apparatus. In order to fulfill such a desire, it is advantageous to use an image forming apparatus in which, when a developing unit is attached to each of the plurality of attach/detach sections, the image forming apparatus can be used as a color image forming apparatus for forming color imaged by developing the latent image bore on the image bearing body with the developer contained in each of the developing units; and on the other hand, when a developing unit is attached to only one of the plurality of attach/detach sections, the image forming apparatus can be used as a single-color image forming apparatus for forming a single-color image by developing the latent image bore on the image bearing body with the developer contained in that developing unit.

(1) Usually, a user makes an image forming apparatus, of the type described above, form monochrome images when the image forming apparatus is being used as a monochrome image forming apparatus, and makes the image forming apparatus form color images when it is being used as a color image forming apparatus.

There are situations, however, in which the user gives instructions to the image forming system to form monochrome images when the image forming apparatus is being used as a color image forming apparatus, or conversely, gives instructions to the image forming system to form color images when the image forming apparatus is being used as a monochrome image forming apparatus.

For the sake of achieving simplification of processes, it is preferable that processes of the image forming system are always the same for situations in which the state of use of the image forming apparatus regarding its monochrome/color modes and the instructions relating to monochrome/color image formation do not match, as with the situations described above.

One way to achieve process simplification by adopting common processes is to make the image forming system carry out the image forming processes in both situations described above. In this case, however, if the user gives instructions to the system to form color images when the image forming apparatus is being used as a monochrome image forming apparatus, then images that do not meet the user's expectations will be formed because only the black developing unit containing black developer is attached to the image forming apparatus.

Another way to achieve process simplification by adopting common processes is to make the image forming system not carry out image forming processes at all for both situations described above. This, however, would be disadvantageous for the user if he/she gives instructions to the system to form monochrome images when the image forming apparatus is being used as a color image forming apparatus, because the structure of the image forming apparatus allows it to form monochrome images even when it is being used as a color image forming apparatus.

(2) Further, users are supplied with drivers that are capable of instructing image forming apparatuses of the type described above to execute image formation. It may be disadvantageous for the user, however, if the same driver is used as the driver for instructing the image forming apparatus to execute image formation when it is being used as a color image forming apparatus, and as the driver for instructing the image forming apparatus to execute image formation when it is being used as a single-color image forming apparatus. For example, if the driver is capable of being commonly used for instructing both color-image formation and single-color-image formation, then, in cases where the user instructs execution of color-image formation when the image forming apparatus is being used as a single-color image forming apparatus, the driver will instruct the image forming apparatus, which is being used as a single-color image forming apparatus, to form color images. As a result, contrary to the user's intentions, the user may not be able to obtain the images that he/she wishes. On the contrary, if a driver is capable of instructing execution of only single-color-image formation, then the driver could only instruct the image forming apparatus to form single-color images, even when it is being used as a color image forming apparatus.

SUMMARY OF THE INVENTION

The present invention has been made in view of the above and other problems, and an object thereof is to achieve an image forming system and an image forming apparatus which are convenient for users.

(1) A first aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus and that has a driver capable of instructing the image forming apparatus to execute at least either single-color-image formation or color-image formation, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus forms an image when the driver instructs the image forming apparatus that is being used as the color image forming apparatus to execute single-color-image formation; and the image forming apparatus does not form an image when the driver instructs the image forming apparatus that is being used as the single-color image forming apparatus to execute color-image formation.

(2) A second aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus and that has at least one driver capable of instructing the image forming apparatus to execute image formation, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and a driver for instructing the image forming apparatus to execute image formation when the image forming apparatus is being used as the color image forming apparatus is different from a driver for instructing the image forming apparatus to execute image formation when the image forming apparatus is being used as the single-color image forming apparatus.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 11 is a diagram showing a relationship between execution/non-execution of image formation, apparatus-type information, and information in control signals COM;

FIG. 13 is a diagram showing a relationship between values of attachment information and operations of setting the apparatus-type information;

FIG. 16 is a diagram showing a relationship between execution/non-execution of image formation, the apparatus-type information, and the information in the control signals COM;

FIG. 18 is a diagram showing a relationship between the values of the attachment information and operations of setting the apparatus-type information;

DETAILED DESCRIPTION OF THE INVENTION

Figure 1:
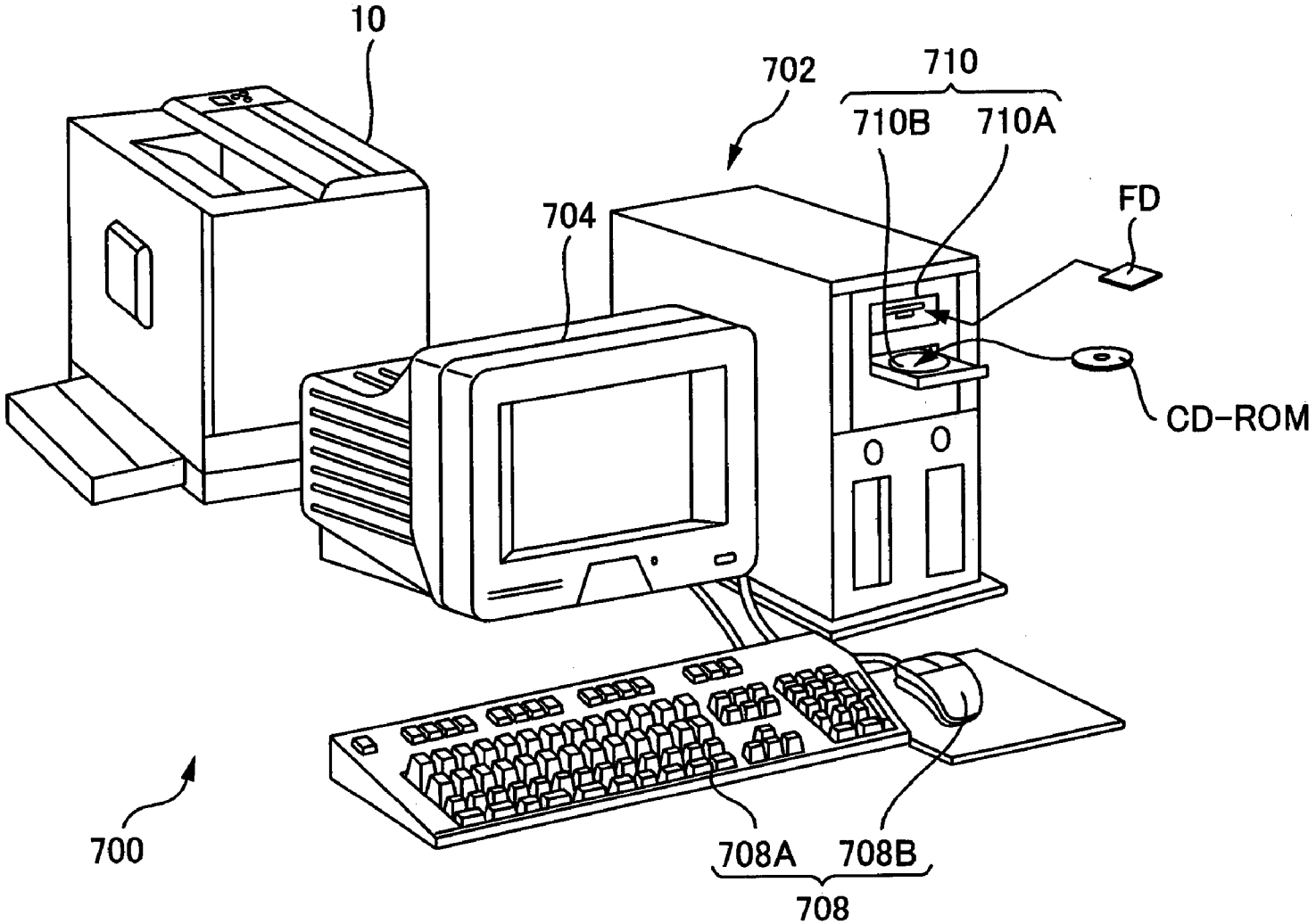
FIG. 1 is an explanatory diagram showing an external configuration of an image forming system 700.

At least the following matters will be made clear by the explanation in the present specification and the description of the accompanying drawings.

(1) A first aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus and that has a driver capable of instructing the image forming apparatus to execute at least either single-color-image formation or color-image formation, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus forms an image when the driver instructs the image forming apparatus that is being used as the color image forming apparatus to execute single-color-image formation; and the image forming apparatus does not form an image when the driver instructs the image forming apparatus that is being used as the single-color image forming apparatus to execute color-image formation.

It is possible to achieve an image forming system that is convenient for users by allowing the image forming apparatus to form an image when the driver instructs the image forming apparatus that is being used as the color image forming apparatus to execute single-color-image formation, and not allowing the image forming apparatus to form an image when the driver instructs the image forming apparatus that is being used as the single-color image forming apparatus to execute color-image formation.

Further, the image forming apparatus may have information indicative of whether the image forming apparatus is being used as the color image forming apparatus or whether the image forming apparatus is being used as the single-color image forming apparatus.

In this way, it is possible to certainly distinguish whether the image forming apparatus is being used as the color image forming apparatus or whether it is being used as the single-color image forming apparatus.

Further, the single-color image forming apparatus may be a monochrome image forming apparatus that forms monochrome images, when a developer container is attached to only one of the plurality of attach/detach sections, by developing the latent image bore on the image bearing body with the developer contained in the developer container.

It is possible to achieve an image forming system that is convenient for users by allowing the image forming apparatus to form an image when the driver instructs the image forming apparatus that is being used as the color image forming apparatus to execute monochrome image formation, and not allowing the image forming apparatus to form an image when the driver instructs the image forming apparatus that is being used as the monochrome image forming apparatus to execute color-image formation.

Further, the driver may be capable of instructing the image forming apparatus to execute color-image formation and single-color-image formation.

This is advantageous because it becomes unnecessary to carry out switching of drivers.

Further, when the driver instructs the image forming apparatus that is being used as the single-color image forming apparatus to execute color-image formation, the image forming system may make a notification to the effect that an image will not be formed.

In this way, it is possible to achieve a user-friendly image forming system.

Further, when the driver instructs the image forming apparatus that is being used as the single-color image forming apparatus to-execute color-image formation, the image forming system may display a notification to the effect that an image will not be formed.

In this way, it is possible to achieve a user-friendly image forming system.

Further, the computer may further comprise a displaying section for displaying information thereon; and when the driver instructs the image forming apparatus that is being used as the single-color image forming apparatus to execute color-image formation, the image forming system may display, on the displaying section, the notification to the effect that an image will not be formed.

In this way, it is possible to achieve an image forming system which is more user-friendly.

It is also possible to provide an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus and that has a driver capable of instructing the image forming apparatus to execute at least either single-color-image formation or color-image formation, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the image forming apparatus forms an image when the driver instructs the image forming apparatus that is being used as the color image forming apparatus to execute single-color-image formation;

the image forming apparatus does not form an image when the driver instructs the image forming apparatus that is being used as the single-color image forming apparatus to execute color-image formation; the image forming apparatus has information indicative of whether the image forming apparatus is being used as the color image forming apparatus or whether the image forming apparatus is being used as the single-color image forming apparatus; the single-color image forming apparatus is a monochrome image forming apparatus that forms monochrome images, when a developer container is attached to only one of the plurality of attach/detach sections, by developing the latent image bore on the image bearing body with the developer contained in the developer container; the driver is capable of instructing the image forming apparatus to execute color-image formation and single-color-image formation; when the driver instructs the image forming apparatus that is being used as the single-color image forming apparatus to execute color-image formation, the image forming system makes a notification to the effect that an image will not be formed; the computer further comprises a displaying section for displaying information thereon; and when the driver instructs the image forming apparatus that is being used as the single-color image forming apparatus to execute color-image formation, the image forming system displays, on the displaying section, the notification to the effect that an image will not be formed.

Another aspect of the present invention is an image forming apparatus comprising: a plurality of attach/detach sections to and from each of which a developer container for containing developer can be attached and detached; and an image bearing body for bearing a latent image, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; in a state where the image forming apparatus is being used as the color image forming apparatus, the image forming apparatus forms an image when the image forming apparatus receives, from a computer, an instruction to execute single-color-image formation; and in a state where the image forming apparatus is being used as the single-color image forming apparatus, the image forming apparatus does not form an image when the image forming apparatus receives, from a computer, an instruction to execute color-image formation.

It is possible to achieve an image forming apparatus that is convenient for users by allowing the image forming apparatus to form an image when the image forming apparatus receives, from a computer, an instruction to execute single-color-image formation in a state where the image forming apparatus is being used as the color image forming apparatus, and not allowing the image forming apparatus to form an image when the image forming apparatus receives, from a computer, an instruction to execute color-image formation in a state where the image forming apparatus is being used as the single-color image forming apparatus.

(2) A second aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus and that has at least one driver capable of instructing the image forming apparatus to execute image formation, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; and a driver for instructing the image forming apparatus to execute image formation when the image forming apparatus is being used as the color image forming apparatus is different from a driver for instructing the image forming apparatus to execute image formation when the image forming apparatus is being used as the single-color image forming apparatus.

It is possible to achieve an image forming system that is convenient for users by making the driver for instructing the image forming apparatus to execute image formation when the image forming apparatus is being used as the color image forming apparatus be different from the driver for instructing the image forming apparatus to execute image formation when the image forming apparatus is being used as the single-color image forming apparatus.

Further, the image forming apparatus may have information indicative of whether the image forming apparatus is being used as the color image forming apparatus or whether the image forming apparatus is being used as the single-color image forming apparatus.

In this way, it is possible to certainly distinguish whether the image forming apparatus is being used as the color image forming apparatus or whether it is being used as the single-color image forming apparatus.

Further, the single-color image forming apparatus may be a monochrome image forming apparatus that forms monochrome images, when a developer container is attached to only one of the plurality of attach/detach sections, by developing the latent image bore on the image bearing body with the developer contained in the developer container.

It is possible to achieve an image forming system that is convenient for users by making the driver for instructing the image forming apparatus to execute image formation when the image forming apparatus is being used as the color image forming apparatus be different from the driver for instructing the image forming apparatus to execute image formation when the image forming apparatus is being used as the monochrome image forming apparatus.

Further, the computer may further comprise a displaying section for displaying information thereon; each driver may be capable of displaying information on the displaying section; and a driver for displaying the information on the displaying section for when the image forming apparatus is being used as the color image forming apparatus may be made to be different from a driver for displaying the information on the displaying section for when the image forming apparatus is being used as the single-color image forming apparatus.

It is possible to achieve an image forming system that is convenient for users by making the driver for displaying the information on the displaying section for when the image forming apparatus is being used as the color image forming apparatus be different from the driver for displaying the information on the displaying section for when the image forming apparatus is being used as the single-color image forming apparatus.

Further, the information that is displayed on the displaying section when the image forming apparatus is being used as the color image forming apparatus may be made to be different from the information that is displayed on the displaying section when the image forming apparatus is being used as the single-color image forming apparatus.

In this way, it is possible to display, on the displaying section, appropriate information that suits the image forming apparatus respectively for when it is being used as a single-color image forming apparatus and for when its is being used as a color image forming apparatus.

Further, the information may be an apparatus-type name of the image forming apparatus.

In this way, the user can easily acknowledge whether the image forming apparatus is being used as a single-color image forming apparatus or as a color image forming apparatus.

Further, the information may be information for making a user set a quality of the image to be formed.

In this way, the user can appropriately set the image quality according to whether the image forming apparatus is being used as a single-color image forming apparatus or as a color image forming apparatus.

Further, information specific to the color image forming apparatus may be displayed on the displaying section when the image forming apparatus is being used as the color image forming apparatus; and the information specific to the color image forming apparatus does not have to be displayed on the displaying section when the image forming apparatus is being used as the single-color image forming apparatus.

In this way, it is possible to display, on the displaying section, the information specific to a color image forming apparatus only when necessary.

It is also possible to provide an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus and that has at least one driver capable of instructing the image forming apparatus to execute image formation, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container;

a driver for instructing the image forming apparatus to execute image formation when the image forming apparatus is being used as the color image forming apparatus is different from a driver for instructing the image forming apparatus to execute image formation when the image forming apparatus is being used as the single-color image forming apparatus; the image forming apparatus has information indicative of whether the image forming apparatus is being used as the color image forming apparatus or whether the image forming apparatus is being used as the single-color image forming apparatus; the single-color image forming apparatus is a monochrome image forming apparatus that forms monochrome images, when a developer container is attached to only one of the plurality of attach/detach sections, by developing the latent image bore on the image bearing body with the developer contained in the developer container; the computer further comprises a displaying section for displaying information thereon; each driver is capable of displaying information on the displaying section; a driver for displaying the information on the displaying section for when the image forming apparatus is being used as the color image forming apparatus is different from a driver for displaying the information on the displaying section for when the image forming apparatus is being used as the single-color image forming apparatus; the information that is displayed on the displaying section when the image forming apparatus is being used as the color image forming apparatus is different from the information that is displayed on the displaying section when the image forming apparatus is being used as the single-color image forming apparatus; the information is an apparatus-type name of the image forming apparatus; the information is information for making a user set a quality of the image to be formed; information specific to the color image forming apparatus is displayed on the displaying section when the image forming apparatus is being used as the color image forming apparatus; and the information specific to the color image forming apparatus is not displayed on the displaying section when the image forming apparatus is being used as the single-color image forming apparatus.

Another aspect of the present invention is an image forming system comprising: an image forming apparatus that includes a plurality of attach/detach sections to and from each of which a developer container for containing developer can be attached and detached and an image bearing body for bearing a latent image; and a computer that is capable of communicating with the image forming apparatus, wherein: when a developer container is attached to each of the plurality of attach/detach sections, the image forming apparatus is usable as a color image forming apparatus for forming a color image by developing the latent image bore on the image bearing body with the developer contained in each developer container; when a developer container is attached to only one of the plurality of attach/detach sections, the image forming apparatus is usable as a single-color image forming apparatus for forming a single-color image by developing the latent image bore on the image bearing body with the developer contained in the developer container; the computer has a color driver that is capable of instructing the image forming apparatus to execute image formation when the image forming apparatus is being used as the color image forming apparatus and a single-color driver that is capable of instructing the image forming apparatus to execute image formation when the image forming apparatus is being used as the single-color image forming apparatus; when the image forming apparatus is being used as the color image forming apparatus, the color driver instructs the image forming apparatus to execute image formation; and when the image forming apparatus is being used as the single-color image forming apparatus, the single-color driver instructs the image forming apparatus to execute image formation.

It is possible to achieve an image forming system that is convenient for users by making the color driver instruct the image forming apparatus to execute image formation when the image forming apparatus is being used as the color image forming apparatus, and making the single-color driver instruct the image forming apparatus to execute image formation when the image forming apparatus is being used as the single-color image forming apparatus.

Overall Configuration Example of Image Forming System

Figure 2:
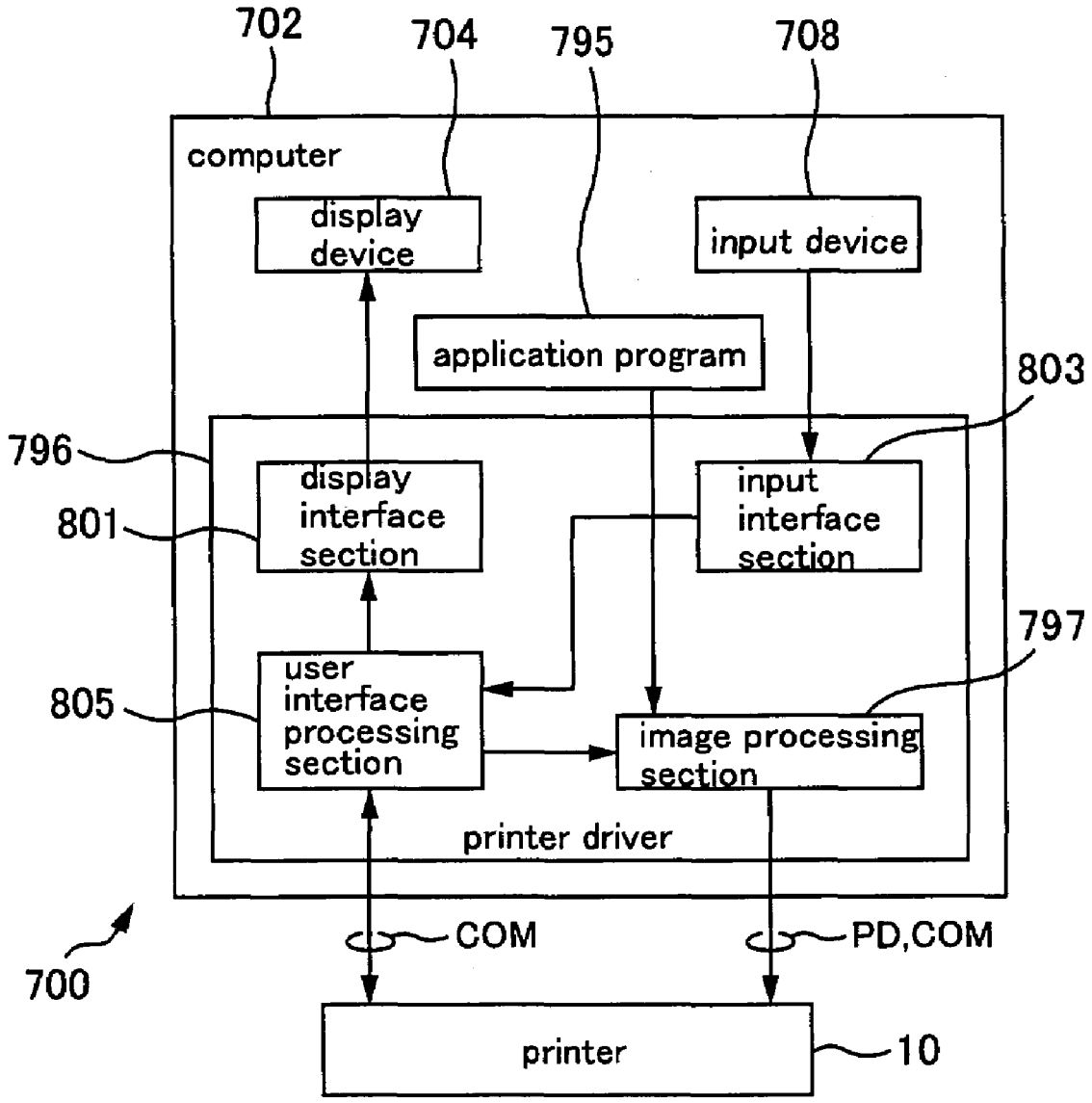
FIG. 2 is a block diagram showing a portion of the structure of the image forming system 700 shown in FIG. 1.

Next, using FIG. 1 and FIG. 2, an outline of an image forming system 700 is described. FIG. 1 is an explanatory diagram showing an external configuration of an image forming system 700. FIG. 2 is a block diagram showing a portion of the structure of the image forming system 700 shown in FIG. 1. The image forming system 700 includes a laser beam printer 10 (which is also referred to as a "printer" below) that serves as an image forming apparatus, and a computer 702 that is capable of communicating with the printer 10. Further, the computer 702 includes a display device 704, such as a CRT (Cathode Ray Tube), a liquid crystal display device, or a plasma display, that serves as an example of a displaying section for displaying information, an input device 708 such as a keyboard 708A and a mouse 708B, a reading device 710 such as an FD (Flexible Disk) device 710A, a CD-ROM drive device 710B, an MO (Magneto Optical) disk drive device (not shown), a DVD (Digital Versatile Disk) device (not shown), an internal memory (not shown) such as a RAM, and an external memory (not shown) such as a hard disk drive unit. Furthermore, in the present embodiment, the computer 702 is contained in a mini-tower-type casing, but this is not a limitation.

The computer 702 also has an operating system, an application program 795 that runs under the operating system, and a printer driver 796 which serves as a driver. The printer driver 796 includes an image processing section 797, a display interface section 801, an input interface section 803, and a user interface processing section 805.

The application program 795 is a program in the computer 702 that makes the printer 10 carry out image formation. In accordance with image-formation execution commands from the application program 795, image data AD in the application program are sent to the printer driver 796.

The image processing section 797 has the functions of receiving the image data AD, which can be interpreted by the application program 795, converting the data AD into image data PD which can be interpreted by the printer 10, and sending the converted image data PD to the printer 10 along with various control signals COM. In other words, the image processing section 797 of the printer driver 796 instructs execution of image formation to the printer 10 after carrying out the above-described image processing. In order to achieve the functions described above, the image processing section 797 executes, for example, resolution conversion, conversion of color components, and so forth.

The display interface section 801 has the function of displaying, on the display device 704, various user-interface windows relating to image formation. The input interface section 803 has the function of receiving input information that has been input by the user with the input device 708 through the user-interface windows.

The user interface processing section 805 has the function of serving as an interface between the printer 10 and the display interface section 801 or the input interface section 803. For example, the user interface processing section 805 receives the input information from the input interface section 803, and interprets the input information. The user interface processing section 805 then sends various command signals COM to the printer 10 and/or the image processing section 797. The user interface processing section 805 also interprets the various command signals COM received from the printer 10 and sends display-related information to the display interface section 801.

It should be noted that the printer driver 796 of the computer 702 is supplied in a form recorded on computer-readable storage media. Various kinds of computer-readable storage media can be used for these storage media, such as flexible disks, CD-ROMs, magneto-optical disks, IC cards, ROM cartridges, punched cards, printed articles on which codes such as barcodes have been printed, internal storage devices in computers (e.g., memories such as RAMs and ROMs), and external storage devices. Furthermore, such computer programs may be downloaded to the computer 702 via the Internet.

Further, although detailed description will be given further below, when developing units are attached to each of the attach/detach sections, the printer 10 according to the present embodiment can be used as a color printer that forms color images by developing a latent image bore on a photoconductor with toner contained in those developing units, and when a developing unit is attached to only one of the attach/detach sections, the printer 10 can be used as a monochrome printer that forms monochrome images by developing a latent image bore on the photoconductor with the toner contained in that developing unit. As regards the printer driver 796, a color driver that corresponds to the printer 10 when it is used as a color printer and a monochrome driver that corresponds to the printer 10 when it is used as a monochrome printer are supplied.

Basically, the user installs, to the computer 702, a color driver when the printer 10 is to be used as a color printer, and a monochrome driver when the printer 10 is to be used as a monochrome printer. There would be no problem, however, in using the monochrome driver when the printer 10 is being used as a color printer, or in using the color driver when the printer 10 is being used as a monochrome printer, if restrictions in functions etc. are not taken into consideration.

The color driver and the monochrome driver differ in terms of the following aspects. First, the monochrome driver does not have functions specific to colors. For example, information specific to colors is not shown on the user-interface windows displayed on the display device 704 by the display interface section 801 of the monochrome driver, and the input interface section 803 of the monochrome driver does not accept input information specific to colors.

On the other hand, the color driver is capable of instructing both execution of color-image formation and execution of monochrome-image formation to the printer 10. More specifically, the display interface section 801 of the color driver displays, on the display device 704, a user-interface window for allowing a user to select either execution of color-image formation or execution of monochrome-image formation. Then, the input interface section 803 receives input information that has been entered by the user through the user-interface window using the input device 708, i.e., information that indicates either execution of color-image formation or execution of monochrome-image formation. The image processing section 797 then receives the information through the user interface processing section 805; if the information indicates execution of color-image formation, then the image processing section executes image processing for forming color images, whereas if the information indicates execution of monochrome-image formation, then it executes image processing for forming monochrome images. After image processing is finished, the monochrome or color image data PD that have been processed are sent to the printer. It should be noted that the monochrome driver can only instruct the printer 10 to execute monochrome-image formation.

Overall Configuration Example of Image Forming Apparatus

Figure 3:
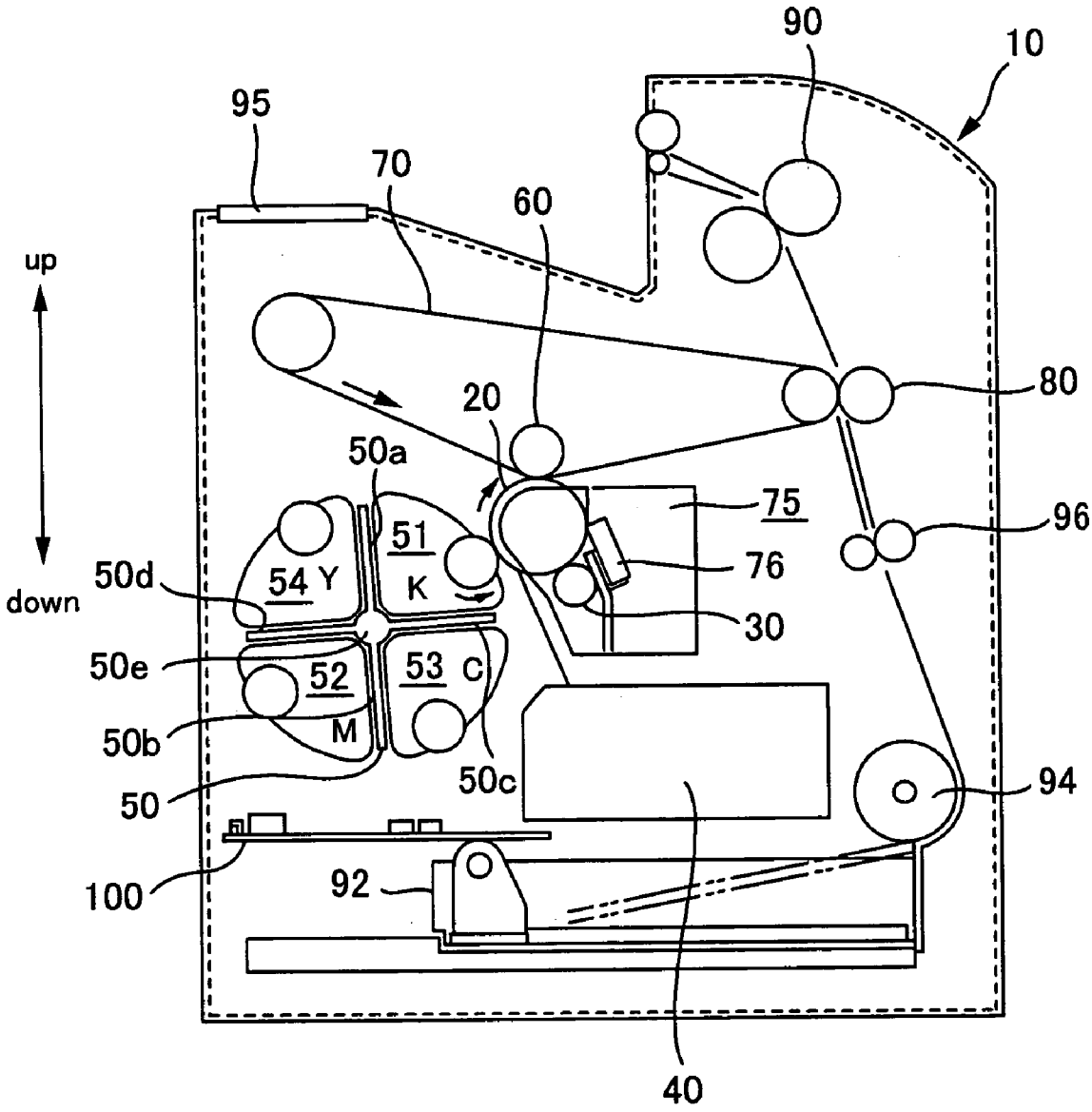
FIG. 3 is a diagram showing main structural components that structure a printer 10 when the printer 10 is being used as a color printer.
Figure 4:
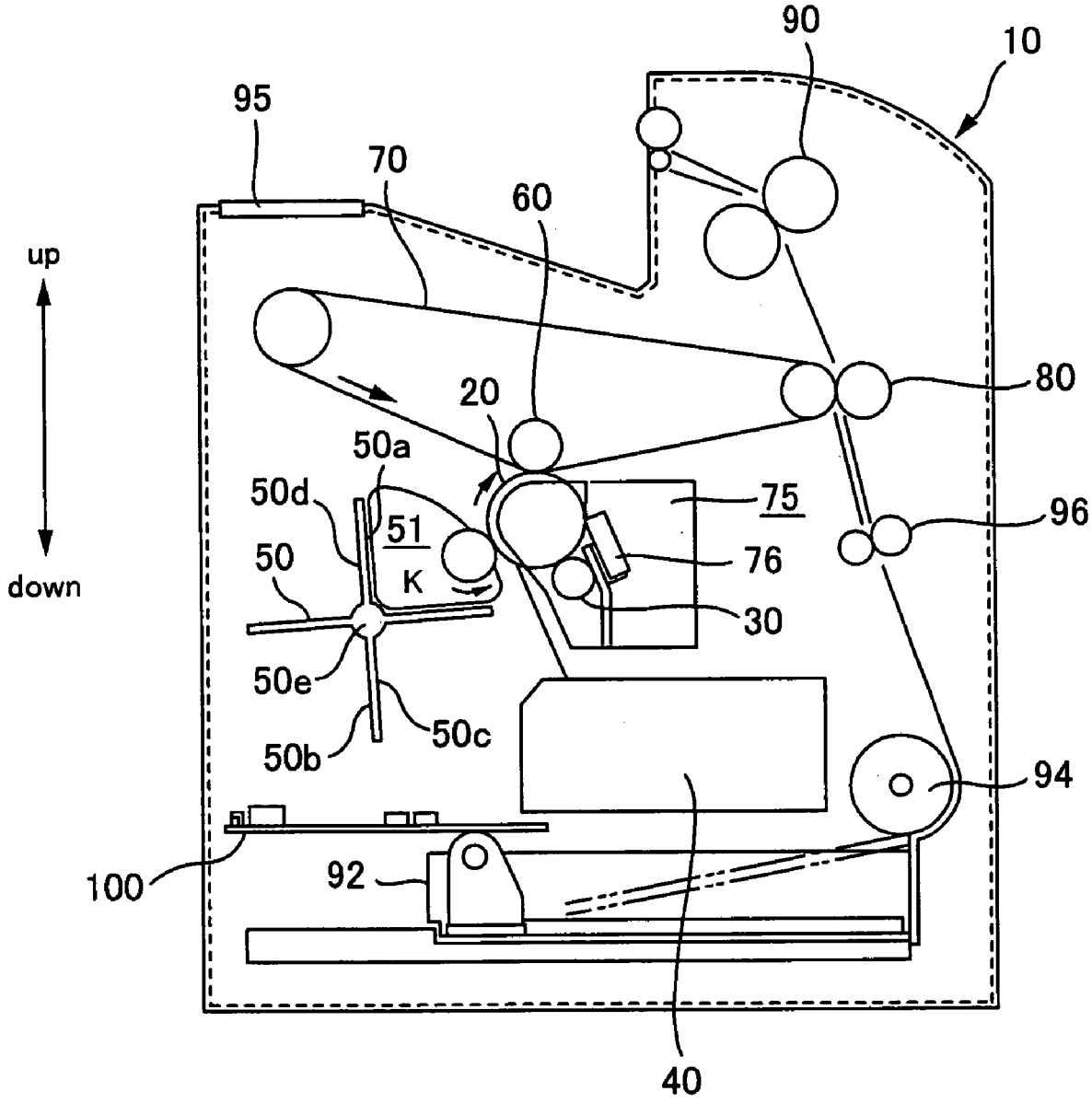
FIG. 4 is a diagram showing main structural components that structure the printer 10 when the printer 10 is being used as a monochrome printer.

Next, using FIG. 3 and FIG. 4, an outline of the printer 10, which is an example of an image-forming apparatus, will be described. FIG. 3 and FIG. 4 are diagrams showing main structural components constructing the printer 10. FIG. 3 is a diagram showing the main structural components for when the printer 10 is used as a color printer, and FIG. 4 is a diagram showing the main structural components for when the printer 10 is used as a monochrome printer. The usage of the printer 10 as a color printer or a monochrome printer will be described in detail further below. Note that in FIG. 3 and FIG. 4, the vertical direction is shown by the arrow, and, for example, a paper supply tray 92 is arranged at a lower section of the printer 10, and a fusing unit 90 is arranged at an upper section of the printer 10.

As shown in FIG. 3 and FIG. 4, the printer 10 includes a charging unit 30, an exposing unit 40, a YMCK developing device 50, a first transferring unit 60, an intermediate transferring body 70, and a cleaning unit 75, all of which being arranged in the direction of rotation of a photoconductor 20 which is for bearing a latent image. The printer 10 further includes a second transferring unit 80, a fusing unit 90, a displaying unit 95 constructed of a liquid-crystal panel and serving as means for making notifications to the user etc., and a control unit 100 for controlling these units etc. and managing the operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 3 and FIG. 4.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, and an F-θ lens, and radiates a modulated laser beam onto the charged photoconductor 20 according to image information having been input from a not-shown computer such as a personal computer or a word processor.

The YMCK developing device 50 has a plurality of attach/detach sections 50*a*, 50*b*, 50*c*, and 50*d* to and from which developing units, which serve as an example of developer containers, can be attached an detached. The YMCK developing device 50 is a device for developing a latent image formed on the photoconductor 20 using toner T, which serves as an example of developer contained in each of the developing units attached to and held by the attach/detach sections.

As described above, when the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units. On the other hand, when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit. In conventional printers, it is not possible to form monochrome images if all of developing units, which contain toner of different colors, are not attached to the YMCK developing device such that the printer is always ready to be able to form color images. On the contrary, the printer 10 according to the present embodiment operates as a monochrome printer that is able to form monochrome images on a medium using a black developing unit 51, even in a state where only the black developing unit 51 is attached.

When the printer 10 is used as a color printer, four developing units—a black developing unit 51, a magenta developing unit 52, a cyan developing unit 53, and a yellow developing unit 54—are attached to the attach/detach sections 50*a*, 50*b*, 50*c*, and 50*d* of the YMCK developing device 50, as shown in FIG. 3, and the latent image formed on the photoconductor 20 is developed with the toner T contained in each of the developing units.

The YMCK developing device 50 can move the positions of the four developing units 51, 52, 53, and 54 by rotating. More specifically, the four developing units 51, 52, 53, and 54 can be rotated about a rotating shaft 50*e* while maintaining their relative positions. Every time an image forming process for one page is finished, each of the developing units selectively opposes the photoconductor 20 to successively develop the latent image formed on the photoconductor 20 using the toner T contained in each of the developing units 51, 52, 53, and 54.

On the other hand, when the printer 10 is used as a monochrome printer, a developing unit is attached to only one of the attach/detach sections of the YMCK developing device 50, as shown in FIG. 4, and the latent image formed on the photoconductor 20 is developed by the toner T contained in that developing unit. More specifically, the black developing unit 51 is attached to an attach/detach section 50*a*, among the four attach/detach sections 50*a*, 50*b*, 50*c*, and 50*d*, and when an image is to be formed, the black developing unit 51 is moved by the rotation of the YMCK developing device 50 to a position in opposition to the photoconductor 20. The latent image formed on the photoconductor 20 is then developed with the black toner T contained in the black developing unit 51.

It should be noted that the developing units and the attach/detach sections according to the present embodiment are physically structured such that a developing unit can only be attached to one attach/detach section corresponding to that developing unit. More specifically, among the four attach/detach sections 50*a*, 50*b*, 50*c*, and 50*d*, the black developing unit 51 can only be attached to the attach/detach section 50*a*, the magenta developing unit 52 can only be attached to the attach/detach section 50*b*, the cyan developing unit 53 can only be attached to the attach/detach section 50*c*, and the yellow developing unit 54 can only be attached to the attach/detach section 50*d*.

Further, details on the YMCK developing device 50 and the developing units will be described further below.

The first transferring unit 60 is a device for transferring, onto the intermediate transferring body 70, a toner image formed on the photoconductor 20.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the toner image formed on the intermediate transferring body 70 onto a medium such as paper, film, and cloth.

The fusing unit 90 is a device for fusing the toner image, which has been transferred to the medium, onto the medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 5:
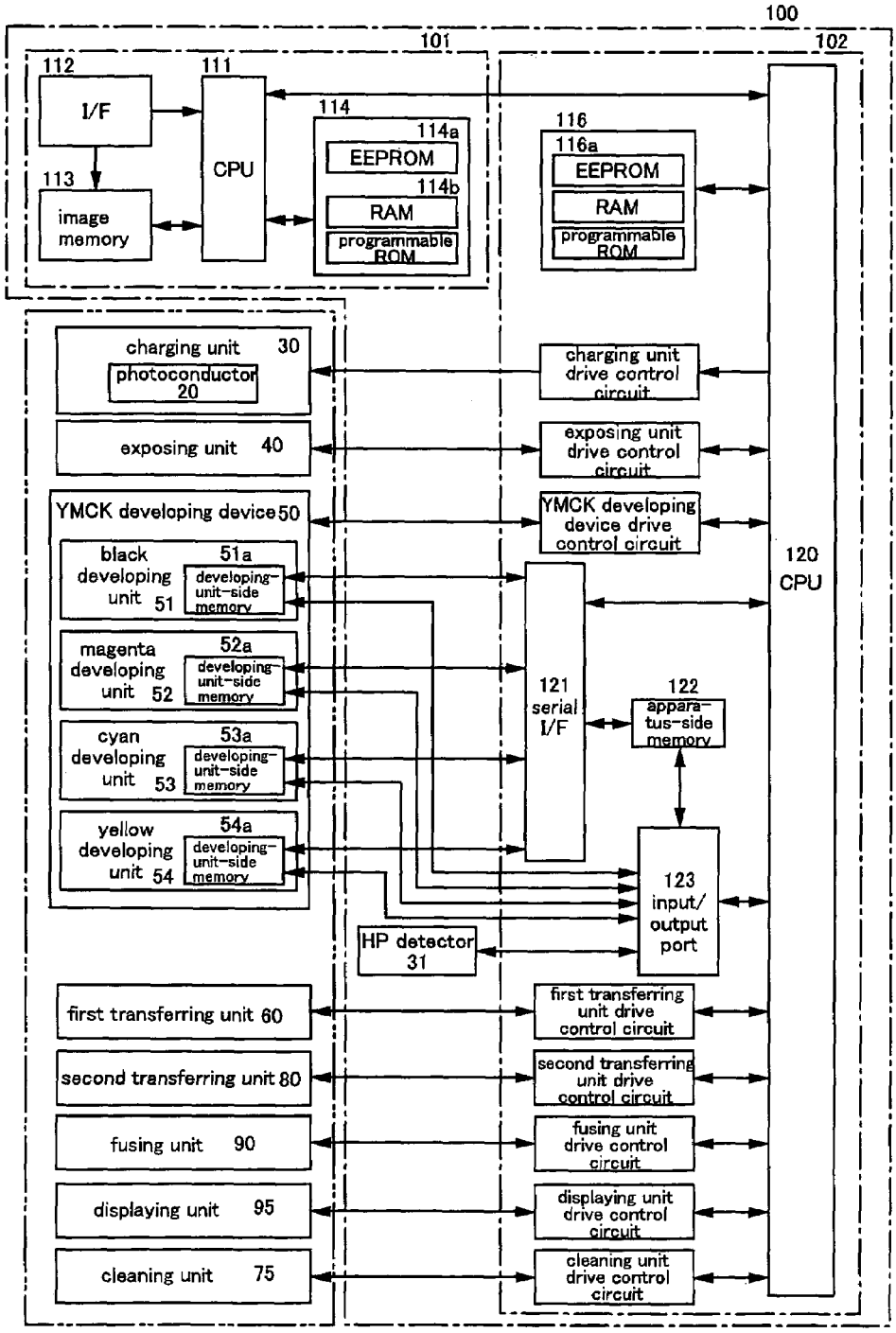
FIG. 5 is a block diagram showing a control unit 100 of the printer 10.

The control unit 100 includes a main controller 101 and a unit controller 102 as shown in FIG. 5. Image data PD and control signals COM are input from the above-described computer 702 to the main controller 101, and according to instructions based on these image data PD and control signals COM, the unit controller 102 controls each of the above-mentioned units etc. to form an image.

Example of Operation of Image Forming Apparatus

Next, operations of the printer 10 structured as above are described separately for when color images are to be formed and for when monochrome images are to be formed. It should be noted that even when the printer 10 is being used as a color printer, the printer 10 is able to form not only color images but also monochrome images. Therefore, the operations described below for when monochrome images are to be formed apply both to the case in which the printer 10 is being used as the above-described color printer to form monochrome images, and the case in which the printer 10 is being used as a monochrome printer to form monochrome images.

Forming Color Images

First, the operations of the printer 10 for when color images are to be formed are described below.

When image data PD and control signals COM are input from the computer 702 to the main controller 101 of the printer 10 through an interface (I/F) 112, the photoconductor 20, a developing roller which is provided in each developing unit, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing device 50 is positioned such that the yellow developing unit 54, which contains yellow (Y) toner, is at the developing position opposing the photoconductor 20.

With the rotation of the photoconductor 20, the latent image formed on the photoconductor 20 reaches the developing position, and is developed with the yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner T is charged, is applied to the first transferring unit 60. It should be noted that, during this process, the photoconductor 20 and the intermediate transferring body 70 are placed in contact with each other, and the second transferring unit 80 is kept separated from the intermediate transferring body 70.

By subsequently performing the above-mentioned processes for the second, the third, and the fourth colors for each of the developing units, toner images in four colors corresponding to the respective image data PD are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into a remaining-toner collector that the cleaning unit 75 comprises.

Forming Monochrome Images

Next, the operations of the printer 10 for when monochrome images are to be formed are described below.

When image data PD and control signals COM are input from the computer 702 to the main controller 101 of the printer 10 through the interface (I/F) 112, the photoconductor 20, the developing roller which is provided in each developing unit, and the intermediate transferring body 70 rotate under the control of the unit controller 102 based on the instructions from the main controller 101. While being rotated, the photoconductor 20 is successively charged by the charging unit 30 at the charging position.

With the rotation of the photoconductor 20, the charged area of the photoconductor 20 reaches the exposing position. A latent image that corresponds to the image information is formed in that area by the exposing unit 40. The YMCK developing device 50 is positioned such that the black developing unit 51, which contains black toner, is at the developing position opposing the photoconductor 20.

With the rotation of the photoconductor 20, the latent image formed on the photoconductor 20 reaches the position where development is possible, and is developed by the black developing unit 51. Thus, a toner image is formed on the photoconductor 20.

With the rotation of the photoconductor 20, the toner image formed on the photoconductor 20 reaches the first transferring position, and is transferred onto the intermediate transferring body 70 by the first transferring unit 60. At this time, a first transferring voltage, which is in an opposite polarity to the polarity to which the toner is charged, is applied to the first transferring unit 60. It should be noted that, during this process, the second transferring unit 80 is kept separated from the intermediate transferring body 70.

With the rotation of the intermediate transferring body 70, the toner image formed on the intermediate transferring body 70 reaches the second transferring position, and is transferred onto a medium by the second transferring unit 80. It should be noted that the medium is carried from the paper supply tray 92 to the second transferring unit 80 via the paper-feed roller 94 and the resisting rollers 96. During transferring operations, a second transferring voltage is applied to the second transferring unit 80 and also the unit 80 is pressed against the intermediate transferring body 70.

The toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected into the remaining-toner collector that the cleaning unit 75 comprises.

Configuration Example of Developing Unit

Figure 6:
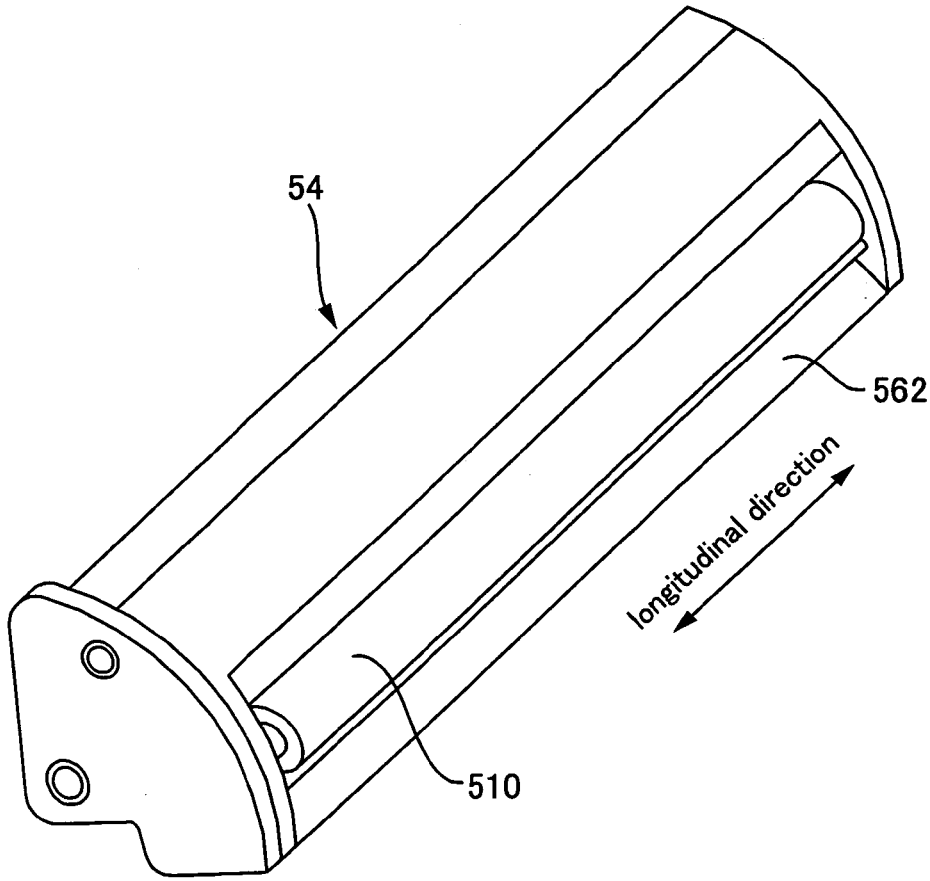
FIG. 6 is a conceptual diagram of a developing unit.
Figure 7:
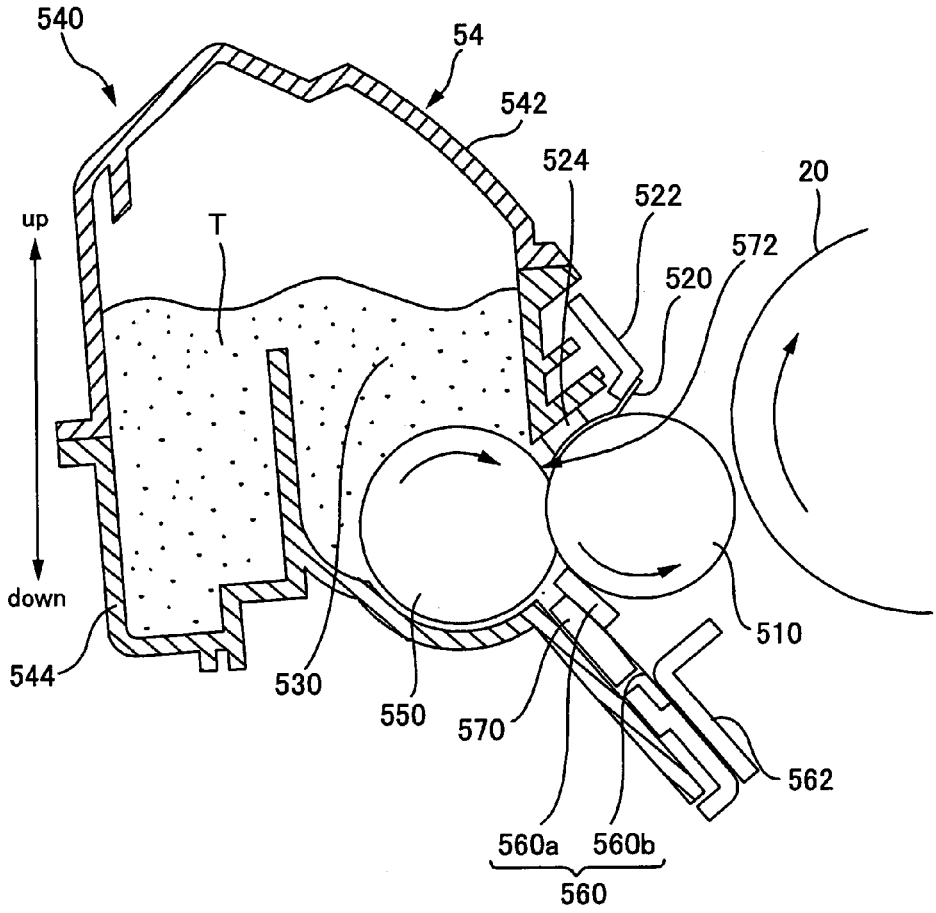
FIG. 7 is a section view showing main structural components of the developing unit.

Next, using FIG. 6 and FIG. 7, an example of a configuration of the developing units will be described. FIG. 6 is a conceptual diagram of a developing unit. FIG. 7 is a section view showing main structural components of the developing unit. Note that the section view shown in FIG. 7 is a cross section of the developing unit bisected by a plane perpendicular to the longitudinal direction shown in FIG. 6. Further, in FIG. 7, the arrow indicates the vertical direction as in FIG. 3, and, for example, the central axis of the developing roller 510 is located below the central axis of the photoconductor 20. Further, in FIG. 7, the yellow developing unit 54 is shown to be in a state in which it is positioned at the developing position opposing the photoconductor 20.

To the YMCK developing device 50, it is possible to attach: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, explanation will be made only about the yellow developing unit 54 below.

The yellow developing unit 54 has, for example, the developing roller 510, a sealing member 520, a toner containing section 530, a housing 540, a toner supplying roller 550, and a restriction blade 560.

The developing roller 510 bears toner T and delivers it to the developing position opposing the photoconductor 20. The developing roller 510 is made of metal and manufactured from, for example, aluminum alloy such as aluminum alloy 5056 or aluminum alloy 6063, or iron alloy such as STKM, and the roller 510 is plated with, for example, nickel plating or chromium plating, as necessary. Further, as shown in FIG. 6, the developing roller 510 is supported at both ends in its longitudinal direction and is rotatable about its central axis. As shown in FIG. 7, the developing roller 510 rotates in the opposite direction (counterclockwise in FIG. 7) to the rotating direction of the photoconductor 20 (clockwise in FIG. 7). The central axis of the roller 510 is located below the central axis of the photoconductor 20. Further, as shown in FIG. 7, in the state where the yellow developing unit 54 opposes the photoconductor 20, there is a gap between the developing roller 510 and the photoconductor 20. That is, the yellow developing unit 54 develops the latent image formed on the photoconductor 20 in a non-contacting state. Note that an alternating field is generated between the developing roller 510 and the photoconductor 20 upon development of the latent image formed on the photoconductor 20.

The sealing member 520 prevents the toner T in the yellow developing unit 54 from spilling out therefrom, and also collects the toner T, which is on the developing roller 510 that has passed the developing position, into the developing unit without scraping it off. The sealing member 520 is a seal made of, for example, polyethylene film. The sealing member 520 is supported by a seal-supporting metal plate 522, and is attached to the housing 540 via the seal-supporting metal plate 522. A seal-urging member 524 made of, for example, Moltoprene is provided on one side of the sealing member 520 opposite to the side of the developing roller 510. The sealing member 520 is pressed against the developing roller 510 by the elastic force of the seal-urging member 524. Note that the abutting position at which the sealing member 520 abuts against the developing roller 510 is situated above the central axis of the developing roller 510.

The housing 540 is manufactured by welding together a plurality of integrally-molded housing sections, that is, an upper housing section 542 and a lower housing section 544. As shown in FIG. 7, the housing 540 has an opening 572 opening toward the outside of the housing 540. The above-mentioned developing roller 510 is arranged from the outside of the housing 540 with its peripheral surface facing the opening 572 in such a state that a part of the roller 510 is exposed to the outside. The restriction blade 560, which is described in detail below, is also arranged from the outside of the housing 540 facing the opening 572.

Further, the housing 540 forms a toner containing section 530 that is capable of containing toner T. The toner containing section 530 may be provided with a stirring member for stirring the toner T. In the present embodiment, however, a stirring member is not provided in the toner containing section 530 because each of the developing units (i.e., the black developing unit 51, the magenta developing unit 52, the cyan developing unit 53, and the yellow developing unit 54) is rotated with the rotation of the YMCK developing device 50 and thereby the toner T in each developing unit is stirred.

The toner supplying roller 550 is provided in the toner containing section 530 described above and supplies the toner T contained in the toner containing section 530 to the developing roller 510. The toner supplying roller 550 is made of, for example, polyurethane foam, and is made to abut against the developing roller 510 in an elastically deformed state. The toner supplying roller 550 is arranged at a lower section of the toner containing section 530. The toner T contained in the toner containing section 530 is supplied to the developing roller 510 by the toner supplying roller 550 at the lower section of the toner containing section 530. The toner supplying roller 550 is rotatable about a central axis. The central axis of the toner supplying roller 550 is situated below the central axis of rotation of the developing roller 510. Further, the toner supplying roller 550 rotates in the opposite direction (clockwise in FIG. 7) to the rotating direction of the developing roller 510 (counterclockwise in FIG. 7). Note that the toner supplying roller 550 has the function of supplying the toner T contained in the toner containing section 530 to the developing roller 510 as well as the function of stripping off, from the developing roller 510, the toner T remaining on the developing roller 510 after development.

The restriction blade 560 restricts the thickness of the layer of the toner T bore by the developing roller 510 and also gives charge to the toner T bore by the developing roller 510. This restriction blade 560 has a rubber section **560*a* and a rubber-supporting section 560*b*. The rubber section 560*a*** is made of, for example, silicone rubber or urethane rubber. The rubber-supporting section 560*b* is a thin plate that is made of, for example, phosphor bronze or stainless steel, and that has a springy characteristic. The rubber section 560*a* is supported by the rubber-supporting section 560*b*. The rubber-supporting section 560*b* is attached to the housing 540 via a pair of blade-supporting metal plates 562 in a state that one end of the rubber-supporting section 560*b* is pinched between and supported by the blade-supporting metal plates 562. Further, a blade-backing member 570 made of, for example, Moltoprene is provided on one side of the restriction blade 560 opposite to the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 evenly.

The end of the restricting blade 560 opposite to the end that is supported by the blade-supporting metal plates 562, i.e., the tip end, is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged such that its tip end faces towards the upper stream of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

In the yellow developing unit 54 thus structured, the toner supplying roller 550 supplies the toner T contained in the toner containing section 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing unit by the sealing member 520 without being scraped off. Then, the toner T that still remains on the developing roller 510 can be stripped off by the toner supplying roller 550.

Each developing unit 51, 52, 53, and 54 is also provided with a storage element (which is also referred to below as a "developing-unit-side memory") 51*a*, 52*a*, 53*a*, and 54*a* that is for storing various kinds of information about the developing unit, such as color information about the color of the toner contained in each developing unit and toner consumption amount, and that is, for example, a non-volatile storage memory such as a serial EEPROM.

Developing-unit-side connectors 51*b*, 52*b*, 53*b*, and 54*b*, which are provided on one end surface of the respective developing units, come into connection, as necessary, with an apparatus-side connector 34, which is provided on the apparatus side (i.e., the printer side), and in this way, the developing-unit-side memories 51*a*, 52*a*, 53*a*, and 54*a* are electrically connected to the unit controller 102 of the control unit 100 of the apparatus.

Overview of YMCK Developing Device

Next, an overview of the YMCK developing device 50 will be described using FIG. 8A, FIG. 8B, and FIG. 8C. It should be noted that in the present section, an example is described in which four developing units 51, 52, 53, and 54 are attached to the respective attach/detach sections 50*a*, 50*b*, 50*c*, and 50*d*, for the sake of convenience. The description below, however, is also applicable to cases in which a developing unit is attached to only one of the four attach/detach sections 50*a*, 50*b*, 50*c*, and 50*d*.

The YMCK developing device 50 has a rotating shaft 50*e* positioned at the center. A support frame 55 for holding the developing units is fixed to the rotating shaft 50*e*. The rotating shaft 50*e* is provided extending between two frame side plates (not shown) which form a casing of the printer 10, and both ends of the shaft 50*e* are supported. It should be noted that the axial direction of the rotating shaft 50*e* intersects with the vertical direction.

The support frame 55 is provided with the four attach/detach sections 50*a*, 50*b*, 50*c*, and 50*d*, by which the above-described developing units 51, 52, 53, and 54 of the four colors are held in an attachable/detachable manner about the rotating shaft 50*e*, in the circumferential direction at an interval of 90°.

A pulse motor, which is not shown, is connected to the rotating shaft 50*e* via a clutch. By driving the pulse motor, it is possible to rotate the support frame 55 and position the four developing units 51, 52, 53, and 54 mentioned above at predetermined positions.

Figure 8A:
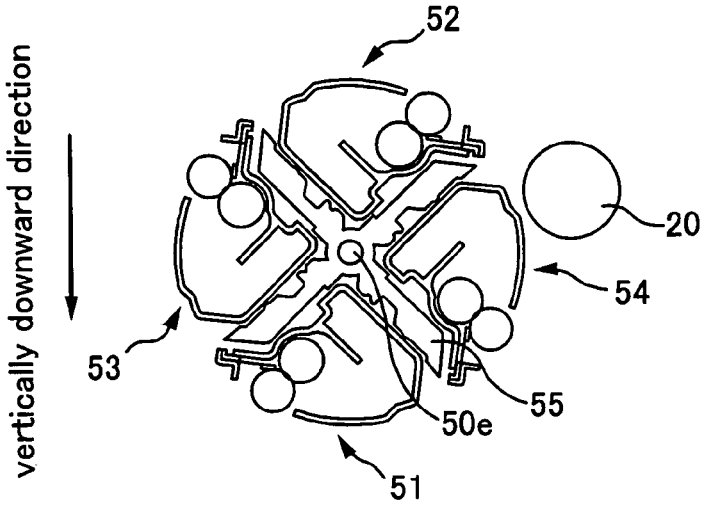
FIG. 8A shows a home position that is the standby position for when the printer is on standby for image formation to be carried out, that is also the halt position, and that serves as a reference position in the rotating direction of a YMCK developing device 50.
Figure 8B:
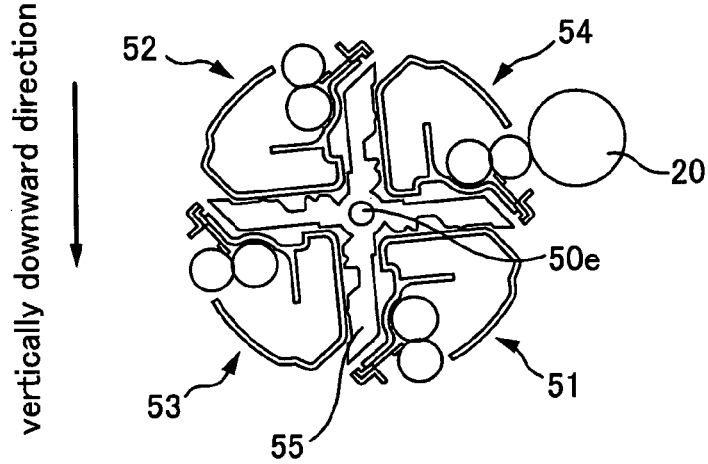
FIG. 8B shows a connector attach/detach position where a developing-unit-side connector 51*b* of a black developing unit 51, which is attached to the YMCK developing device 50, and an apparatus-side connector 34, which is provided on the apparatus side, come into opposition.
Figure 8C:
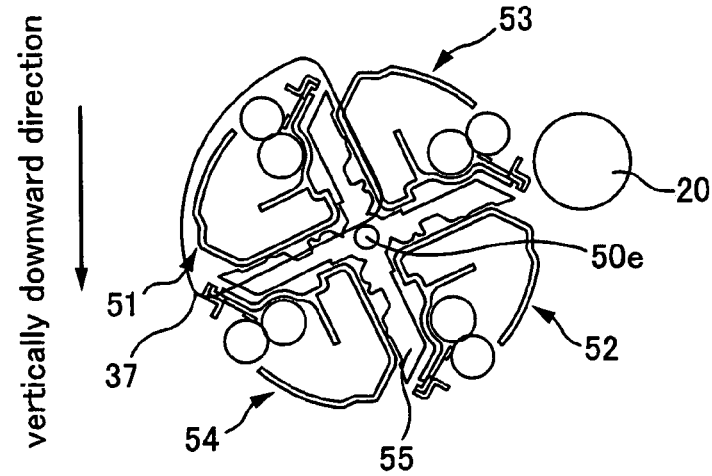
FIG. 8C shows the attach/detach position where the black developing unit 51 is attached and detached.

FIG. 8A, FIG. 8B, and FIG. 8C are diagrams showing three stop positions of the rotating YMCK developing device 50. FIG. 8A shows the home position (referred to as "HP position" below) that is the standby position for when the printer is on standby for image formation to be carried out, that is also the halt position, and that serves as the reference position in the rotating direction of the YMCK developing device 50. FIG. 8B shows the connector attach/detach position where the developing-unit-side connector 51*b* of the black developing unit 51, which is attached to the YMCK developing device 50, and the apparatus-side connector 34, which is provided on the apparatus side, come into opposition. FIG. 8C shows the attach/detach position where the black developing unit 51 is attached and detached.

In FIG. 8B and FIG. 8C, the connector attach/detach position and the developing unit attach/detach position are explained with regard to the black developing unit 51, but these positions become the connector attach/detach position and the developing unit attach/detach position for each of the other developing units when the YMCK developing device 50 is rotated at 90° intervals.

First, the HP position shown in FIG. 8A will be described. An HP detector 31 (FIG. 5) for detecting the HP position is provided on the side of one end of the rotating shaft 50*e* of the YMCK developing device 50. The HP detector 31 is structured of a disk that is for generating signals and that is fixed to one end of the rotating shaft 50*e*, and an HP sensor that is made up of, for example, a photointerrupter having a light emitting section and a light receiving section. The peripheral section of the disk is arranged such that it is located between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing device 50 is detected based on this change in signal level and the number of pulses of the pulse motor, and by taking this HP position as a reference, each of the developing units can be positioned at the developing position etc.

FIG. 8B shows the connector attach/detach position of the black developing unit 51 which is achieved by rotating the pulse motor for a predetermined number of pulses from the above-mentioned HP position. At this connector attach/detach position, the developing-unit-side connector 51*b* of the black developing unit 51, which is attached to the YMCK developing device 50, and the apparatus-side connector 34, which is provided on the apparatus side, come into opposition, and it becomes possible to connect or separate these connectors.

Figure 9A:
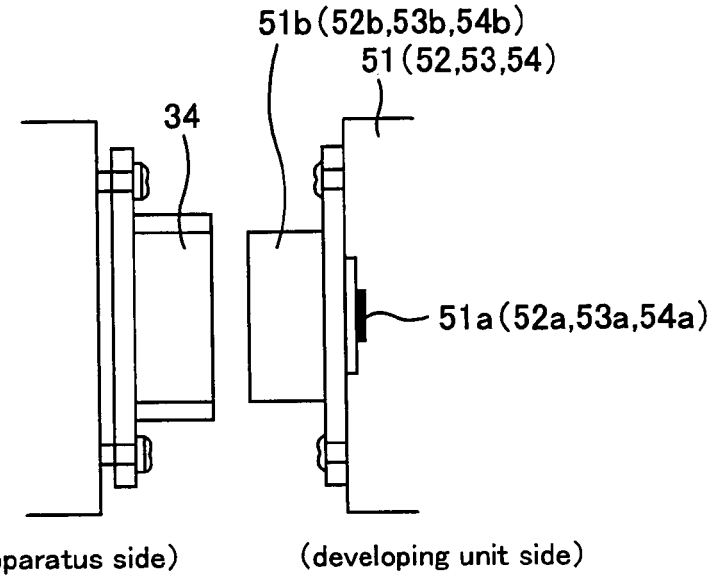
FIG. 9A is a diagram showing a separated position in which the apparatus-side connector 34 and the developing-unit-side connector 51*b* of the black developing unit 51 are separated from each other.
Figure 9B:
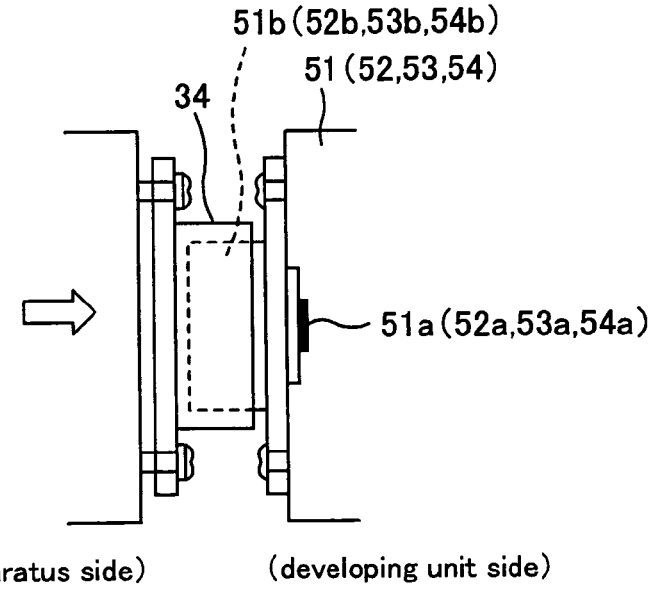
FIG. 9B is a diagram showing an abutting position in which the apparatus-side connector 34 and the developing-unit-side connector 51*b* of the black developing unit 51 are in abutment against each other.

Further explanation is given using FIG. 9A and FIG. 9B. FIG. 9A is a diagram showing a separated position where the apparatus-side connector 34 and the developing-unit-side connector 51*b* of the black developing unit 51 are separated from each other. FIG. 9B is a diagram showing an abutting position where the apparatus-side connector 34 and the developing-unit-side connector 51*b* of the black developing unit 51 are in abutment against each other.

FIG. 9A shows a state in which the apparatus-side connector 34 and the developing-unit-side connector 51*b* of the black developing unit 51 are separated from each other. The apparatus-side connector 34 is structured such that it can move close to, and move away from, the black developing unit 51. When necessary, the apparatus-side connector 34 moves in the direction towards the black developing unit 51 (the direction of the arrow shown in FIG. 9B). In this way, the apparatus-side connector 34 abuts against the developing-unit-side connector 51*b* of the black developing unit 51 as shown in FIG. 9B. Thus, the developing-unit-side memory 51*a* attached to the black developing unit 51 is electrically connected to the unit controller 102 of the control unit 100, and communication between the developing-unit-side memory 51 and the apparatus is established.

On the contrary, the apparatus-side connector 34 moves, from the state shown in FIG. 9B in which the apparatus-side connector 34 and the developing-unit-side connector 51*b* of the black developing unit 51 abut against each other, in the direction moving away from the black developing unit 51 (the direction opposite to the direction of the arrow shown in FIG. 9B). In this way, the apparatus-side connector 34 is separated from the developing-unit-side connector 51*b* of the black developing unit 51, as shown in FIG. 9A.

It should be noted that the movement of the apparatus-side connector 34 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the apparatus-side connector 34 from the predetermined separated position for a distance that corresponds to the above-mentioned number of pulses to position the apparatus-side connector 34 at the predetermined abutting position. On the contrary, by rotating the pulse motor backwards for a predetermined number of pulses, the above-mentioned mechanism moves the apparatus-side connector 34 from the predetermined abutting position for a distance that corresponds to the above-mentioned number of pulses to position the apparatus-side connector 34 at the predetermined separated position.

Further, the connector attach/detach position for the black developing unit 51 becomes the developing position for the yellow developing unit 54 where the developing roller 510 of the yellow developing unit 54 and the photoconductor 20 oppose each other. That is, the connector attach/detach position of the YMCK developing device 50 for the black developing unit 51 is the developing position of the YMCK developing device 50 for the yellow developing unit 54. Further, the position achieved when the pulse motor rotates the YMCK developing device 50 counterclockwise by 90° becomes the connector attach/detach position for the cyan developing unit 53 and the developing position for the black developing unit 51, and by rotating the YMCK developing device 50 at 90° intervals, the connector attach/detach position and the developing position for each of the developing units are successively achieved.

One of the two frame side plates that support the YMCK developing device 50 and that form the casing of the printer 10 is provided with an attach/detach dedicated opening 37 through which one developing unit can pass. The attach/detach dedicated opening 37 is formed at a position where only a relevant developing unit (here, the black developing unit 51) can be pulled out and be detached in the direction of the rotating shaft 50*e*, as shown in FIG. 8C, when the YMCK developing device 50 is rotated and then halted at a developing unit attach/detach position which is set for each developing unit. Further, the attach/detach dedicated opening 37 is formed slightly larger than the outer shape of a developing unit. At the developing unit attach/detach position, not only is it possible to detach the developing unit, but it is also possible to insert a new developing unit through this attach/detach dedicated opening 37 in the direction of the rotating shaft 50*e* and attach the developing unit to the support frame 55. While the YMCK developing device 50 is positioned at positions other than the developing unit attach/detach position, the attachment/detachment of that developing unit is restricted by the frame side plates.

It should be noted that a lock mechanism, which is not shown, is provided for certainly positioning and fixing the YMCK developing device 50 at the positions described above.

Overview of Control Unit

Next, with reference to FIG. 5, the configuration of the control unit 100 will be described. The control unit 100 includes a main controller 101 and a unit controller 102.

The main controller 101 includes a CPU 111, an interface 112 for establishing communication with the computer 702, an image memory 113 for storing image data PD that have been input from the computer 702, and a main-controller-side memory 114 that is made up of, for example, an electrically rewritable EEPROM 114*a*, a RAM 114*b*, and a programmable ROM in which various programs for control are written.

The CPU 111 of the main controller 101 manages control of writing and reading of image data PD, which have been input via the interface, to and from the image memory 113, as well as manages overall control of the apparatus in synchronism with the CPU 120 of the unit controller 102 according to control signals COM that have been input from the computer 702.

Further, the EEPROM 114*a* stores apparatus-type information indicative of whether the printer 10 is to be used as a color printer or as a monochrome printer. Although detailed description will be given further below, the CPU 111 receives, from the unit controller 102 at predetermined timings, developing-unit attachment information which indicates where, among the four attach/detach sections, the developing units are currently attached. Based on the attachment information, the CPU 111 rewrites the apparatus-type information in the EEPROM 114*a*, if necessary. It should be noted that the apparatus-type information is 1-bit information that is written in the EEPROM 114*a*; value "0" indicates that the printer 10 is to be used as a color printer, and value "1" indicates that the printer 10 is to be used as a monochrome printer.

The unit controller 102 includes, for example, a CPU 120, a unit-controller-side memory 116 that is made up of, for example, an electrically rewritable EEPROM 116*a*, a RAM, and a programmable ROM in which various programs for control are written, and various drive control circuits for driving and controlling the units in the apparatus body (i.e., the charging unit 30, the exposing unit 40, the first transferring unit 60, the cleaning unit 75, the second transferring unit 80, the fusing unit 90, and the displaying unit 95) and the YMCK developing device 50.

The CPU 120 of the unit controller 102 is electrically connected to each of the drive control circuits and controls the drive control circuits according to control signals from the CPU 111 of the main controller 101. More specifically, the CPU 120 controls each of the units and the YMCK developing device 50 according to signals received from the main controller 101 while detecting the state of each of the units and the YMCK developing device 50 by receiving signals from sensors provided in each unit.

The CPU 120 also controls each of the drive control circuits according to the apparatus-type information described above. More specifically, if the value of the apparatus-type information is "0", then the CPU 120 controls the units and the YMCK developing device 50 of the printer 10 to function as a color printer, and if the value of the apparatus-type information is "1", then the CPU 120 controls the units and the YMCK developing device 50 of the printer 10 to function as a monochrome printer.

The EEPROM 116*a* stores the developing-unit attachment information which indicates where, among the four attach/detach sections, the developing units are currently attached. Although detailed description will be given further below, after detachment and attachment of a developing unit, the CPU 120 determines whether the developing unit has been attached to the corresponding attach/detach section, and according to the determination results, it rewrites the attachment information in the EEPROM 116*a*, if necessary. It should be noted that the attachment information is written in the EEPROM 116*a* as 4-bit information, i.e., 1-bit information for each attach/detach section; value "0" indicates that no developing unit is attached, and value "1" indicates that a developing unit is attached.

Further, the CPU 120 of the unit controller 102 is connected, via a serial interface (I/F) 121, to a non-volatile storage element 122 (which is referred to below as "apparatus-side memory") which is, for example, a serial EEPROM. Data necessary for controlling the apparatus are stored in the apparatus-side memory 122. The CPU 120 is not only connected to the apparatus-side memory 122, but is also connected to the developing-unit-side memories 51*a*, 52*a*, 53*a*, and 54*a*, which are provided on the respective developing units 51, 52, 53, and 54, via the serial interface 121. Therefore, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via the input/output port 123. The CPU 120 is also connected to the HP detector 31 via the input/output port 123.

First Example of Operations Carried Out by the Image Forming System

A first example of operations carried out by the image forming system 700 is described below.

As described above, when the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit.

Below, operations of the image forming system 700 for when (1) a user gives instructions to execute monochrome-image formation when the printer 10 is being used as a color printer, (2) the printer 10 is then switched from a color printer to a monochrome printer, and (3) the user gives instructions to execute color-image formation when the printer 10 is being used as a monochrome printer are described. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

It should be noted that in the present embodiment, the color driver described above is used as the printer driver 796, regardless of whether the printer 10 is being used as a color printer or as a monochrome printer.

Figure 10:
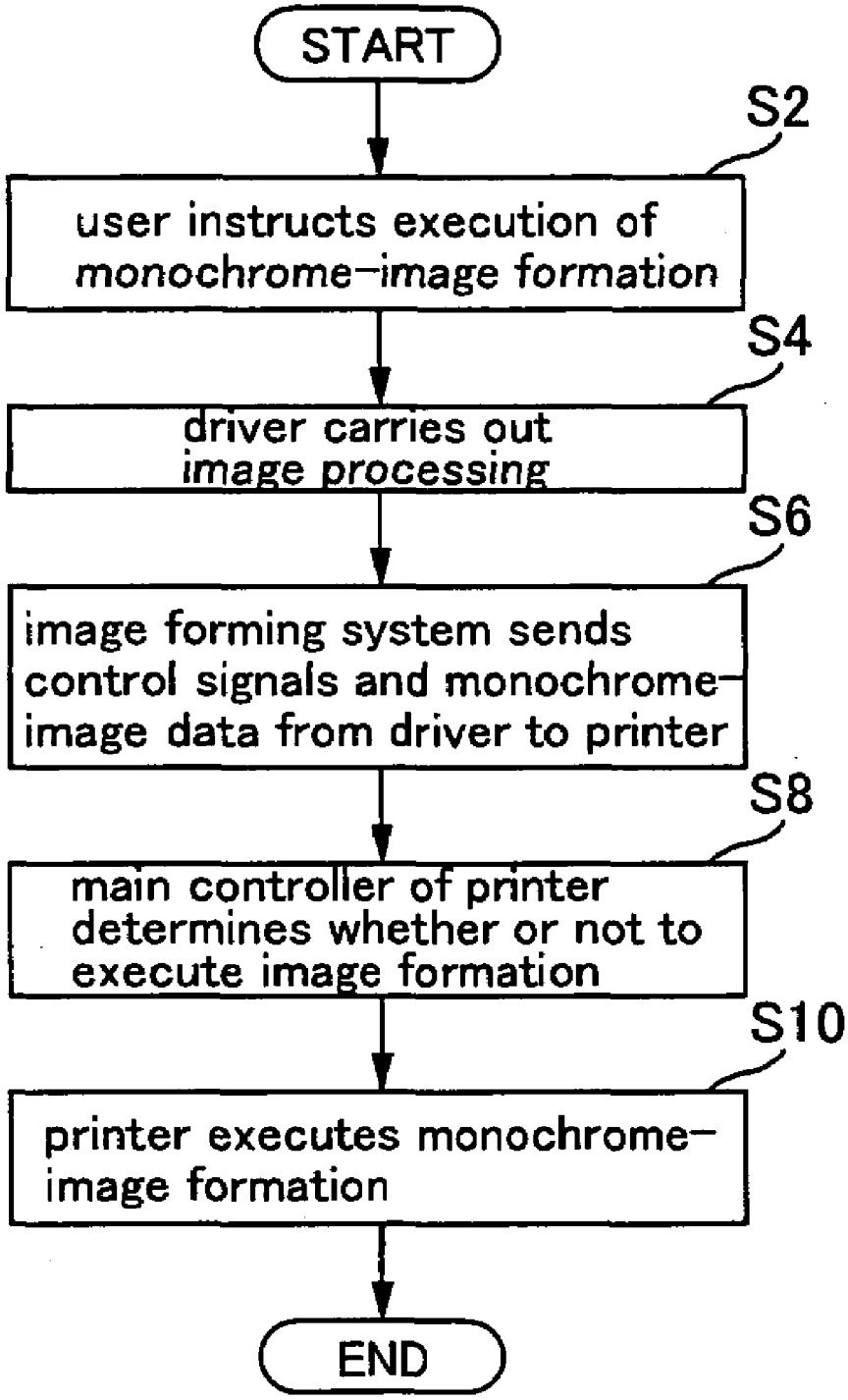
FIG. 10 is a flowchart for illustrating operations of the image forming system 700 for when a user gives instructions to perform monochrome-image formation in a state where the printer 10 is being used as a color printer.

Operations of the Image Forming system for When a User Gives Instructions to Execute Monochrome-Image Formation in a State Where the Printer 10 is Being Used as a Color Printer First, operations of the image forming system 700 for when a user gives instructions to execute monochrome-image formation in a state where the printer 10 is being used as a color printer is described using FIG. 10. FIG. 10 is a flowchart for illustrating operations of the image forming system 700 for when a user gives instructions to perform monochrome-image formation in a state where the printer 10 is being used as a color printer.

This flowchart starts from a state in which the power of the printer 10 and the computer 702 has already been turned ON and the system is on standby for execution of image formation. Further, since the printer 10 is being used as a color printer, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, the user operates the above-described application program 795 to give instructions to the image forming system 700 to execute image formation (step S2). According to these instructions, image data AD in the application program is transferred from the application program 795 to the image processing section 797 of the printer driver 796. At this time, the user also enters information instructing execution of monochrome-image formation through the user interface window displayed on the display device 704 using the input device 708 (step S2). The input interface section 803 of the printer driver 796 that has received the entered information sends the information to the user interface processing section 805. The user interface processing section 805 processes the received information, and sends the information to the printer 10 and the image processing section 797 as control signals COM.

The image processing section 797 receives, as control signals COM, the information indicative of execution of monochrome-image formation, and based on this information, it processes the image data AD that it received from the application program 795 (step S4). That is, image processing for carrying out monochrome-image formation is executed by the image processing section 797. After the image processing is finished, monochrome-image data PD, which have been obtained by the processing, are sent to the printer 10.

Finally, the control signals COM, which are indicative of execution of monochrome-image formation, and the monochrome-image data PD are sent from the printer driver 796 to the printer 10 (step S6). Through these operations, the printer driver 796 instructs the printer 10 to carry out image formation.

The printer 10 receives the monochrome-image data PD and the control signals COM, which are indicative of execution of monochrome-image formation, from the computer 702 via the interface (I/F) 112. The printer 10 temporarily stores the received monochrome-image data PD in the image memory 113 of the main controller 101. The CPU 111 of the main controller 101 then determines whether image formation is to be executed or not according to the information in the control signals COM (step S8).

The way in which the CPU 111 determines whether image formation is to be executed or not is described below. The printer 10 with its power turned ON has apparatus-type information, in the RAM 114*b* of the main controller 101, that indicates whether the printer 10 is being used as a color printer or as a monochrome printer. (Details of this will be given further below.) The CPU 111 determines whether image formation is to be executed or not by comparing the apparatus-type information and the information in the control signals COM. More specifically, if the apparatus-type information indicates that the printer 10 is being used as a color printer and the information in the control signals COM indicates execution of color-image formation, then the CPU 111 selects execution of image formation. The CPU 111 selects execution of image formation also for the case where the apparatus-type information indicates "monochrome printer" and the information in the control signals COM indicates execution of monochrome-image formation, and for the case where the apparatus-type information indicates "color printer" and the information in the control signals COM indicates execution of monochrome-image formation. On the other hand, if the apparatus-type information indicates that the printer 10 is being used as a monochrome printer and the information in the control signals COM indicates execution of color-image formation, then the CPU 111 selects not to execute image formation. The relationship between execution/non-execution of image formation, the apparatus-type information, and the information in the control signals COM is as shown in FIG. 11.

In the present example, the apparatus-type information indicates "color printer" and the information in the control signals COM indicates execution of monochrome-image formation. Therefore, the CPU 111 of the main controller 101 selects execution of image formation. Then, under control of the unit controller 102 according to commands from the main controller 101, the printer 10 carries out the operations described in the section of "Example of operation of image forming apparatus <Forming monochrome images>" above. In this way, a monochrome image is formed on the medium (step S10).

Switching from Color Printer to Monochrome Printer

Figure 12:
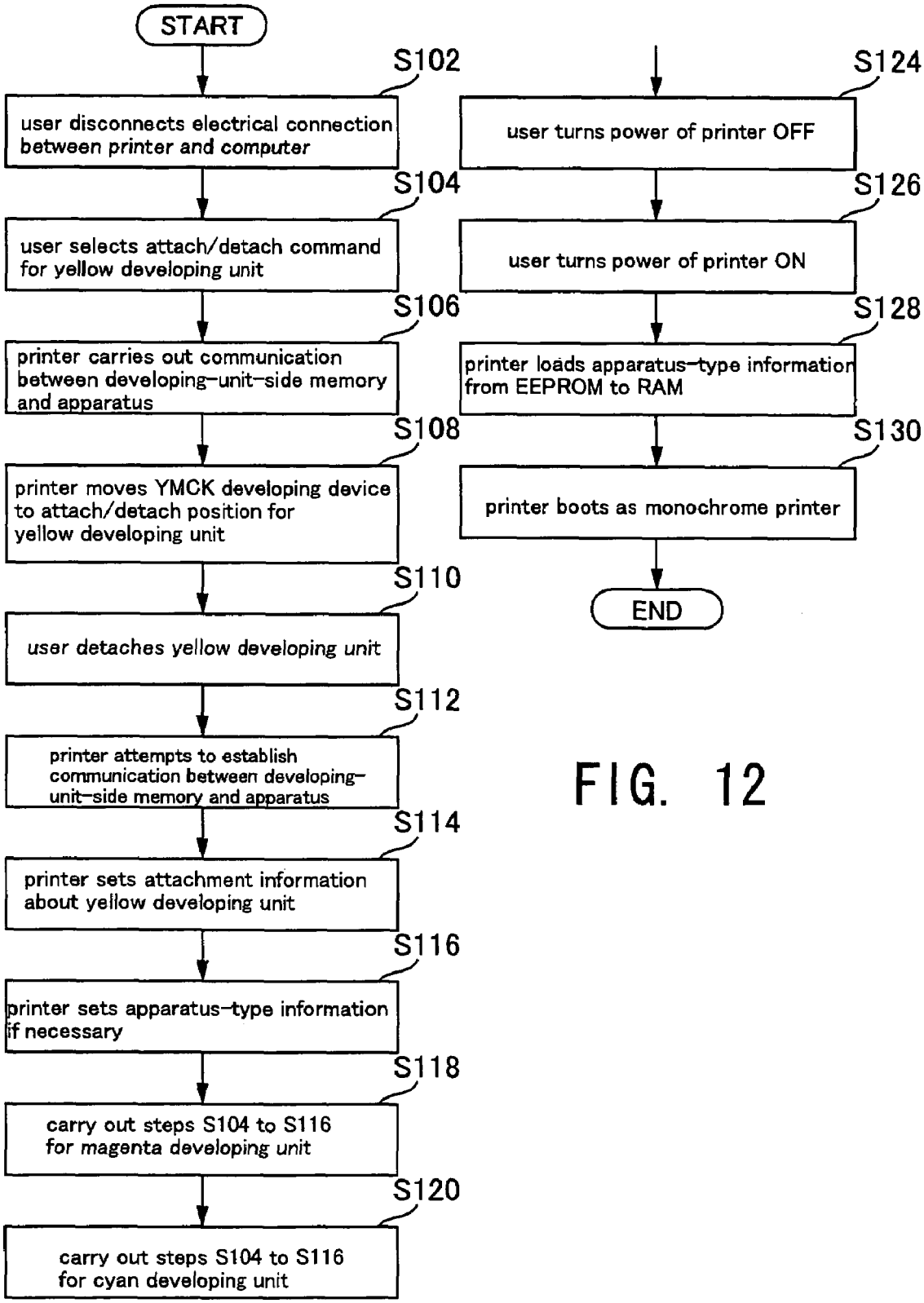
FIG. 12 is a flowchart for illustrating a procedure for switching the printer 10 from a color printer to a monochrome printer.

Next, switching of the printer 10 from a color printer to a monochrome printer will be described using FIG. 12. FIG. 12 is a flowchart for illustrating the procedure for switching the printer 10 from a color printer to a monochrome printer.

This flowchart starts from a state in which the power of the printer 10 has already been turned ON and the printer 10 is on standby for image formation to be carried out. The standby position of the YMCK developing device 50 at this time is the HP position shown in FIG. 8A.

Further, the printer 10, before switching is performed, is used as a color printer, and therefore, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, if the printer 10 is electrically connected to a computer, then the user disconnects the electrical connection by turning the power of the computer OFF, disconnecting the cable that connects the printer 10 and the computer, and so forth (step S102.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S104). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S106).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S108).

In this state, the unit controller 102 notifies the user that the yellow developing unit 54 can be detached from (or attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S110). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S112). If communication succeeds, then the unit controller 102 assumes that the yellow developing unit 54 is attached, and sets the attachment information for the yellow developing unit 54 in the EEPROM 116*a* to "1". On the other hand, if communication fails, then the unit controller 102 assumes that the yellow developing unit 54 is not attached, and sets the attachment information for the yellow developing unit 54 in the EEPROM 116*a* to "0" (step S114). In the present embodiment, since the yellow developing unit 54 has been detached at step S110, it is assumed that the communication has failed, and the attachment information for the yellow developing unit 54 in the EEPROM 116*a* is changed from "1" to "0".

After finishing the above-described processes relating to the attachment information, the unit controller 102 sends the attachment information for all four developing units to the main controller 101. The main controller 101 receives the attachment information and sets the above-described apparatus-type information based on the attachment information (step S116).

An algorithm according to which the main controller 101 sets the apparatus-type information based on the attachment information of the four developing units is described below. If the value of only one of the four pieces of attachment information is "1", which indicates that a developing unit is attached, then the main controller 101 sets the value of the apparatus-type information in the EEPROM 114*a* to "1", which indicates that the printer is to be used as a monochrome printer. On the other hand, if the value of two or more pieces of attachment information is "1", then the main controller 101 sets the value of the apparatus-type information to "0", which indicates that the printer is to be used as a color printer. In both cases, however, if the value of the attachment information for the black developing unit 51 is "0", then the main controller 101 does not execute the operation of setting the apparatus-type information. (That is, if the black developing unit 51, which should be attached regardless of whether the printer is to be used as a color printer or as a monochrome printer, is not attached, the apparatus-type information is not rewritten and the value of the apparatus-type information is kept the same.) The relationship between the values of the attachment information and the operations of setting the apparatus-type information is as shown in FIG. 13.

In the present embodiment, the value of the attachment information only for the yellow developing unit 54 is "0" (and this situation matches case "P" of FIG. 13). Therefore, the main controller 101 sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 13).

Next, the processes from step S104 through step S116 described above are carried out for the cyan developing unit 53 and the magenta developing unit 52 (step S118 and step S120). As a result of carrying out these processes, the values of the attachment information for the cyan developing unit 53 and the magenta developing unit 52 are rewritten from "1" to "0". The values of the attachment information of the developing units received by the main controller 101 become "1" for the black developing unit, "0" for the magenta developing unit, "0" for the cyan developing unit, and "0" for the yellow developing unit (i.e., the values match case "I" of FIG. 13). Therefore, the main controller 101 changes the value of the apparatus-type information from "0", which indicates "color printer", to "1", which indicates "monochrome printer", in accordance with the algorithm described above.

Next, the user temporarily halts power supply to the printer by turning the power of the printer 10 OFF, for example (step S124). The user then supplies power to the printer again by turning the power of the printer 10 ON, for example (step S126).

When power is supplied to the printer 10, the main controller 101 detects this and loads the apparatus-type information from the EEPROM 114*a* to the RAM 114*b* (step S128). Here, the value "1", which indicates "monochrome printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S130).

As described above, switching of the printer 10 from a color printer to a monochrome printer is executed when: the state of the printer 10 changes from a state where developing units are attached to at least two of the four attach/detach sections to a state where a developing unit is attached only to the attach/detach section 50*a* by detaching developing units from attach/detach sections other than the attach/detach section 50*a* while power is being supplied to the printer 10; and the power supply to the printer 10 is once stopped and then started again.

In other words, the apparatus-type information will not be loaded from the EEPROM 114*a* to the RAM 114*b* only by changing the state of the printer 10 from a state where developing units are attached to at least two of the four attach/detach sections to a state where a developing unit is attached only to the attach/detach section 50*a*. Therefore, in this case, the value of the apparatus-type information in the RAM 114*b* remains the same as that before the change in state (i.e., the value remains at "0" indicative of "color printer"), and the printer 10 will not switch from the color printer to the monochrome printer. The apparatus-type information is loaded to the RAM 114*b* only after power is supplied again to the printer 10 at step S126, and in this case, the printer 10 refers to the apparatus-type information in the RAM 114*b* and boots as a monochrome printer.

It should be noted that in the present example, it is possible to detach developing units from attach/detach sections other than the attach/detach section 50*a*, in order to change the state of the printer 10 from a state where developing units are attached to at least two attach/detach sections to a state where a developing unit is attached only to the attach/detach section 50*a*, only when power is being supplied to the printer 10.

<Operations of the Image Forming System for When a User Gives Instructions to Execute Color-Image Formation in a State Where the Printer 10 is Being Used as a Monochrome Printer>

Figure 14:
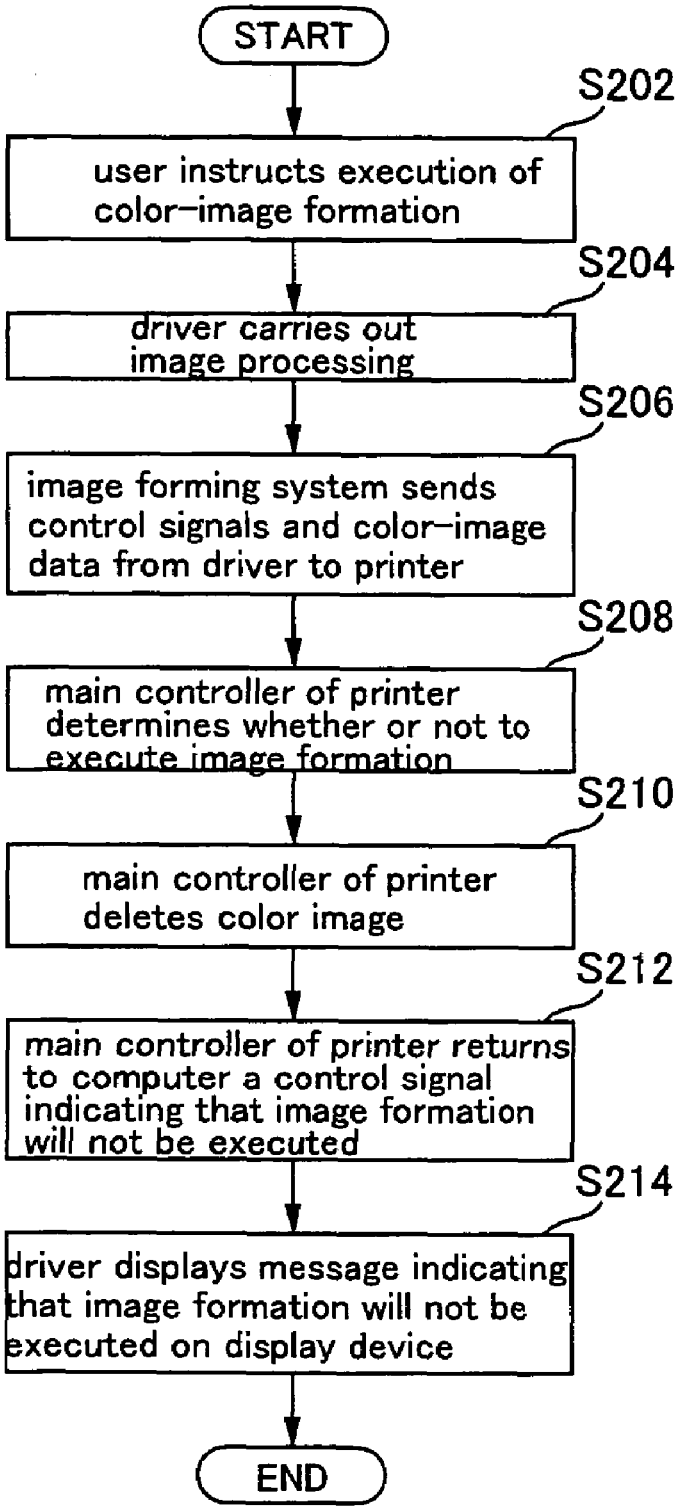
FIG. 14 is a flowchart for illustrating operations of the image forming system 700 for when a user gives instructions to perform color-image formation in a state where the printer 10 is being used as a monochrome printer.

Next, operations of the image forming system 700 for when a user gives instructions to execute color-image formation in a state where the printer 10 is being used as a monochrome printer is described using FIG. 14. FIG. 14 is a flowchart for illustrating operations of the image forming system 700 for when a user gives instructions to perform color-image formation in a state where the printer 10 is being used as a monochrome printer.

This flowchart starts from a state in which the power of the printer 10 and the computer 702 has already been turned ON and the system is on standby for execution of image formation. Further, since the printer 10 is being used as a monochrome printer, only one developing unit is attached to one of the four attach/detach sections, as shown in FIG. 4. That is, the black developing unit 51 is attached to the attach/detach section 50*a*, whereas no developing unit is attached to the other attach/detach sections 50*b*, 50*c*, and 50*d*.

First, the user operates the above-described application program 795 to give instructions to the image forming system 700 to execute image formation (step S202). According to these instructions, image data AD in the application program is transferred from the application program 795 to the image processing section 797 of the printer driver 796. At this time, the user also enters information instructing execution of color-image formation through the user interface window displayed on the display device 704 using the input device 708 (step S202). The input interface section 803 of the printer driver 796 that has received the entered information sends the information to the user interface processing section 805. The user interface processing section 805 processes the received information, and sends the information to the printer 10 and the image processing section 797 as control signals COM.

The image processing section 797 receives, as control signals COM, the information indicative of execution of color-image formation, and based on this information, it processes the image data AD that it received from the application program 795 (step S204). That is, image processing for carrying out color-image formation is executed by the image processing section 797. After the image processing is finished, color-image data PD, which have been obtained by the processing, are sent to the printer 10.

Finally, the control signals COM, which are indicative of execution of color-image formation, and the color-image data PD are sent from the printer driver 796 to the printer 10 (step S206). Through these operations, the printer driver 796 instructs the printer 10 to carry out image formation.

The printer 10 receives the color-image data PD and the control signals COM, which are indicative of execution of color-image formation, from the computer 702 via the interface (I/F) 112. The printer 10 temporarily stores the received color-image data PD in the image memory 113 of the main controller 101. The CPU 111 of the main controller 101 then determines whether image formation is to be executed or not according to the criterion for determination shown in FIG. 11 (step S208).

In the present example, the apparatus-type information indicates "monochrome printer" and the information in the control signals COM indicates execution of color-image formation. Therefore, the CPU 111 of the main controller 101 selects not to execute image formation. The CPU 111 then deletes the color-image data PD temporarily stored in the image memory (step S210), and returns, to the computer 702, a control signal COM indicating that it will not execute image formation, without giving out any commands relating to image formation to the unit controller 102 (step S212).

The user interface processing section 805 of the computer 702 receives the control signal COM and interprets its contents. Then, it gives out a command to the display interface section 801 to display a message indicating that image formation will not be executed. Receiving this command, the display interface section 801 displays, on the display device 704, a message indicating that image formation will not be executed (step S214). In other words, when the printer driver 796 gives an instruction to execute color-image formation to the printer 10 that is being used as a monochrome printer, the image forming system 700 displays, on the display device 704, a notification to the effect that image formation will not be executed.

The description above was about the operations of the image forming system for when instructions to execute monochrome-image formation were given in a state where the printer was being used as a color printer, and the operations of the image forming system for when instructions to execute color-image formation were given in a state where the printer was being used as a monochrome printer. That is, the printer that is being used as a color printer forms images when the printer driver gives an instruction to execute monochrome-image formation to the printer. On the other hand, the printer that is being used as a monochrome printer does not form images when the printer driver gives an instruction to execute color-image formation to the printer. In this way, it is possible to achieve an image forming system that is convenient for users.

That is, as described in the section of the "Description of the Related Art" etc., there are situations in which the user gives instructions to the image forming system to form monochrome images when the printer is being used as a color printer, or on the contrary, gives instructions to the image forming system to form color images when the printer is being used as a monochrome printer.

For the sake of achieving simplification of processes, it is preferable that processes of the image forming system are always the same for situations in which the state of use of the printer regarding its monochrome/color modes and the instructions relating to monochrome/color image formation do not match, as with the situations described above.

One way to achieve process simplification by adopting common processes is to make the image forming system carry out the image forming processes in both situations described above. In this case, however, if the user gives instructions to the system to form color images when the printer is being used as a monochrome printer, then images that do not meet the user's expectations will be formed because only the black developing unit containing black developer is attached to the printer.

Another way to achieve process simplification by adopting common processes is to make the image forming system not carry out image forming processes at all for both situations described above. This, however, would be disadvantageous for the user if he/she gives instructions to the system to form monochrome images when the printer is being used as a color printer, because the structure of the printer allows it to form monochrome images even when it is being used as a color printer.

In view of the above, the system of the present example is configured such that the printer that is being used as a color printer forms images when the printer driver gives an instruction to execute monochrome-image formation to the printer, whereas the printer that is being used as a monochrome printer does not form images when the printer driver gives an instruction to execute color-image formation to the printer. In this way, it is possible to avoid the problem in that images that do not meet the user's expectations are formed when the user gives instructions to form color images in a state where the printer is being used as a monochrome printer. It is also possible to avoid the problem in that it would be disadvantageous for the user if he/she gives instructions to form monochrome images when the printer is being used as a color printer.

Consequently, it becomes possible to achieve an image forming system that is convenient for users.

Other Considerations

In the foregoing example, a color driver and a monochrome driver were supplied as the printer driver. This, however, is not a limitation, and for example, a printer driver that can be shared for both the monochrome and color modes may be supplied. In this case, the computer may obtain, from the printer, information about whether the printer is being used as a color printer or as a monochrome printer, and switch the monochrome/color mode of the printer driver.

Further, in the foregoing example, the printer driver was capable of instructing the printer to execute both color-image formation and single-color-image formation, but this is not a limitation. That is, in the foregoing example, a color driver that is capable of instructing execution of color-image formation and monochrome-image formation regardless of whether the printer is being used as a color printer or as a monochrome printer was used as the printer driver, but this is not a limitation. For example, it is possible to use, as the printer driver, a color printer when the printer is being used as a color printer, and use, as the printer driver, a monochrome driver when the printer is being used as a monochrome printer.

The foregoing example, however, is more preferable in terms that, by using a color driver as the printer driver regardless of whether the printer is being used as a color printer or as a monochrome printer, it becomes unnecessary to switch from a color driver to a monochrome driver after switching the printer from a color printer to a monochrome printer.

Further, in the foregoing example, when the printer driver instructed the printer that is being used as the single-color printer to execute color-image formation, the image forming system made a notification to the effect that an image will not be formed. This, however, is not a limitation. The system does not have to make such a notification.

The foregoing example, however, is more preferable in terms that, by making a notification to the effect that an image will not be formed, it is possible to achieve a user-friendly image forming system.

Further, in the foregoing example, when the printer driver instructed the printer that is being used as the single-color printer to execute color-image formation, the image forming system displayed a notification to the effect that an image will not be formed. This, however, is not a limitation. For example, the system may make the notification through voice or sound.

Further, in the foregoing example, when the printer driver instructed the printer that is being used as the single-color printer to execute color-image formation, the image forming system displayed, on the display device of the computer, the notification to the effect that an image will not be formed. This, however, is not a limitation. For example, such a notification may be displayed on the displaying section of the printer.

However, the user is usually looking at the display device of the computer when he/she instructs the image forming system to execute image formation. The foregoing example is therefore more preferable in terms that, by displaying the notification indicating that an image will not be formed on the display device of the computer, it is possible to achieve an image forming system which is more user-friendly.

Second Example of Operations Carried Out by the Image Forming System

Next, a second example of operations carried out by the image forming system 700 is described below.

As described above, when the developing units are attached to each of the attach/detach sections 50*a*, 50*b*, 50*c*, and 50*d*, the printer 10 according to the present embodiment can be used as a color printer for forming color images by developing the latent image bore on the photoconductor 20 using the toner T contained in each of the developing units, whereas when a developing unit is attached to only one of the attach/detach sections 50*a*, 50*b*, 50*c*, or 50*d*, then the printer 10 can be used as a monochrome printer for forming monochrome images by developing the latent image bore on the photoconductor 20 using the toner T contained in that developing unit.

Below, operations of the image forming system 700 for when (1) a user gives instructions to execute color-image formation when the printer 10 is being used as a color printer, (2) the printer 10 is then switched from a color printer to a monochrome printer, and (3) the user gives instructions to execute monochrome-image formation when the printer 10 is being used as a monochrome printer are described. The various operations of the printer 10 described below are mainly achieved by the main controller 101 or the unit controller 102 in the printer 10. Particularly, in the present embodiment, the operations are achieved by the CPU executing programs that are stored in the programmable ROM. The programs are made of codes for achieving the various operations described below.

It should be noted that in the present embodiment, the color driver described above is used as the printer driver 796 when the printer 10 is being used as a color printer, whereas the monochrome driver described above is used as the printer driver 796 when the printer 10 is being used as a monochrome printer.

Figure 15:
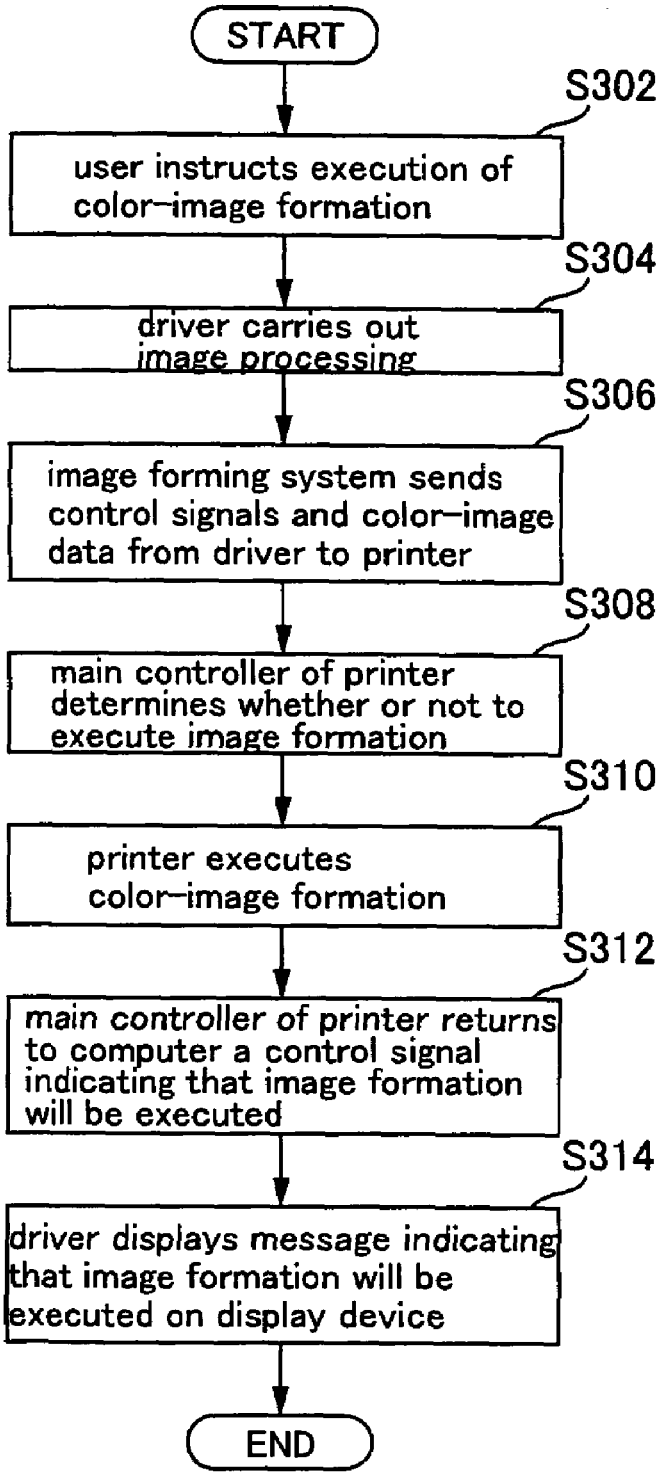
FIG. 15 is a flowchart for illustrating operations of the image forming system 700 for when a user gives instructions to perform color-image formation in a state where the printer 10 is being used as a color printer.

Operations of the Image Forming System for When a User Gives Instructions to Execute Color-Image Formation in a State Where the Printer 10 is Being Used as a Color Printer First, operations of the image forming system 700 for when a user gives instructions to execute color-image formation in a state where the printer 10 is being used as a color printer is described using FIG. 15. FIG. 15 is a flowchart for illustrating operations of the image forming system 700 for when a user gives instructions to perform color-image formation in a state where the printer 10 is being used as a color printer.

This flowchart starts from a state in which the power of the printer 10 and the computer 702 has already been turned ON and the system is on standby for execution of image formation. Further, since the printer 10 is being used as a color printer, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, the user operates the above-described application program 795 to give instructions to the image forming system 700 to execute image formation (step S302). According to these instructions, image data AD in the application program is transferred from the application program 795 to the image processing section 797 of the printer driver 796. At this time, the user also enters information instructing execution of color-image formation, as well as information about the quality of the image to be formed, using the input device 708 through the user interface window displayed on the display device 704 by the display interface section 801 of the printer driver 796 (step S302).

Figure 20:
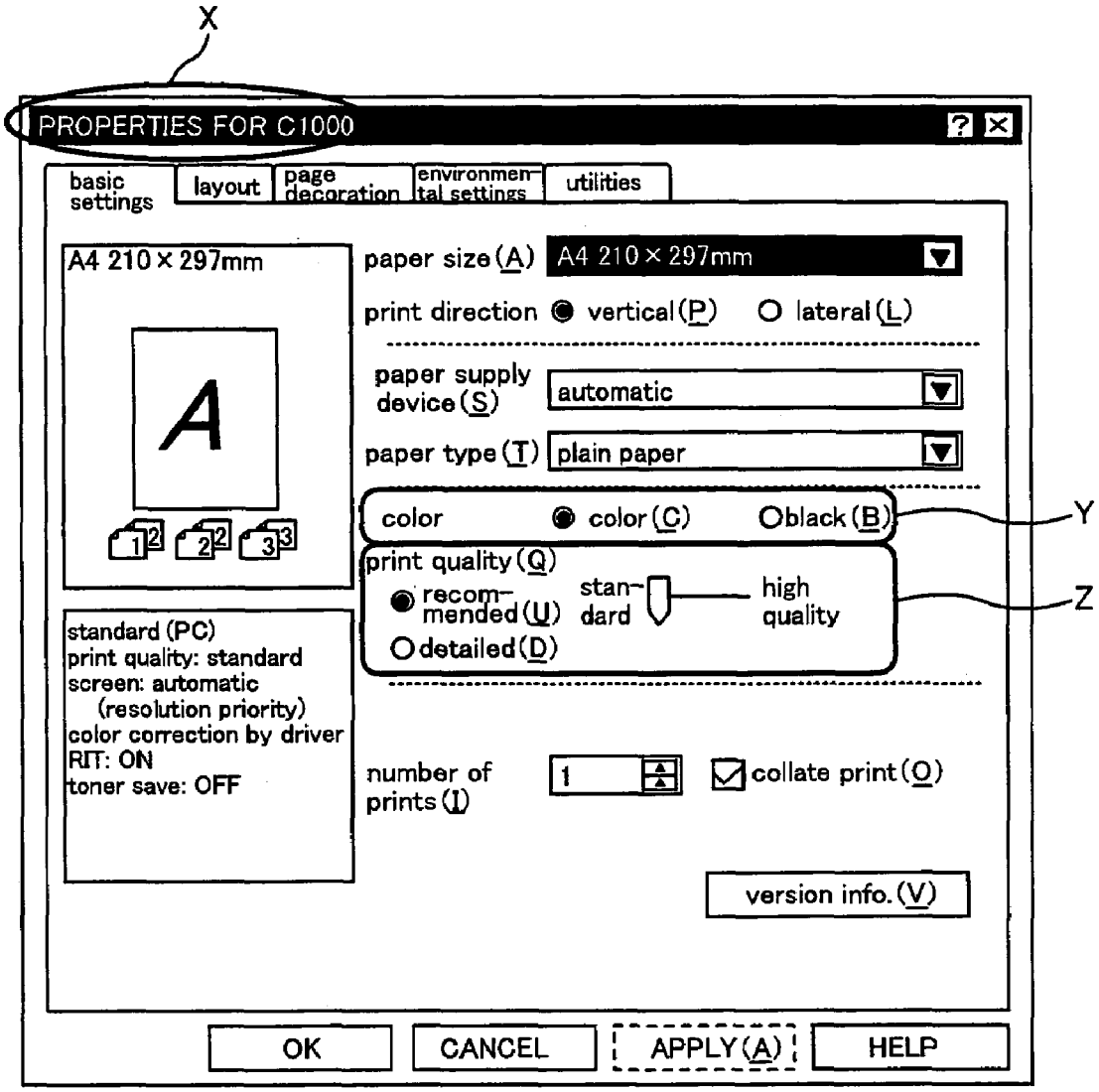
FIG. 20 is a diagram showing an example of a user interface window displayed by a color driver on a display device 704.

The user interface window is described below using FIG. 20. FIG. 20 is a diagram showing an example of a user interface window displayed on the display device 704 by the color driver. In FIG. 20, the apparatus-type name of the printer 10 is displayed in the section marked with "X". The apparatus-type name differs for when the printer 10 is being used as a color printer and for when it is being used as a monochrome printer. In the present example, the apparatus-type name for the former case is "C1000", whereas the apparatus-type name for the latter case is "B1000". Further, in the present example, since the printer 10 is being used as a color printer, the apparatus-type name "C1000" is displayed on the user interface window.

Further, in FIG. 20, information for making the user select either execution of color-image formation or execution of monochrome-image formation is displayed in the section marked with "Y". The user can select either execution of color-image formation or execution of monochrome-image formation by operating the radio buttons on the user interface window with the mouse.

Further, in FIG. 20, information for making the user set the quality of the image to be formed is displayed in the section marked with "Z". The user can select either "recommended" or "detailed" by operating the radio buttons on the user interface window with the mouse. When the user selects "recommended", it becomes possible for the user to further set the level of image quality. On the other hand, when the user selects "detailed", a window having displayed thereon information for making the user set the image quality in further detail pops up, whereby it becomes possible for the user to set the image quality in further detail through the window.

The input interface section 803 of the printer driver 796 that has received the information indicative of execution of color-image formation, as well as the information indicative of the quality of the image to be formed, sends the information to the user interface processing section 805. The user interface processing section 805 processes the received information, and sends, as control signals COM, the information indicative of execution of color-image formation to the printer 10, and the information indicative of execution of color-image formation, as well as the information indicative of the quality of the image to be formed, to the image processing section 797.

The image processing section 797 receives, as control signals COM, the information indicative of execution of color-image formation, as well as the information indicative of the quality of the image to be formed, and based on this information, it processes the image data AD that it received from the application program 795 (step S304). That is, image processing for carrying out color-image formation is executed by the image processing section 797. After the image processing is finished, color-image data PD, which have been obtained by the processing, are sent to the printer 10.

Finally, the control signals COM, which are indicative of execution of color-image formation, and the color-image data PD are sent from the printer driver 796 to the printer 10 (step S306). Through these operations, the printer driver 796 instructs the printer 10 to carry out image formation.

The printer 10 receives the color-image data PD and the control signals COM, which are indicative of execution of color-image formation, from the computer 702 via the interface (I/F) 112. The printer 10 temporarily stores the received color-image data PD in the image memory 113 of the main controller 101. The CPU 111 of the main controller 101 then determines whether image formation is to be executed or not according to the information in the control signals COM (step S308).

The way in which the CPU 111 determines whether image formation is to be executed or not is described below. The printer 10 with its power turned ON has apparatus-type information, in the RAM 114*b* of the main controller 101, that indicates whether the printer 10 is being used as a color printer or as a monochrome printer. (Details of this will be given further below.) The CPU 111 determines whether image formation is to be executed or not by comparing the apparatus-type information and the information in the control signals COM. More specifically, if the apparatus-type information indicates that the printer 10 is being used as a color printer and the information in the control signals COM indicates execution of color-image formation, then the CPU 111 selects execution of image formation. The CPU 111 selects execution of image formation also for the case where the apparatus-type information indicates "monochrome printer" and the information in the control signals COM indicates execution of monochrome-image formation, and for the case where the apparatus-type information indicates "color printer" and the information in the control signals COM indicates execution of monochrome-image formation. On the other hand, if the apparatus-type information indicates that the printer 10 is being used as a monochrome printer and the information in the control signals COM indicates execution of color-image formation, then the CPU 111 selects not to execute image formation. The relationship between execution/non-execution of image formation, the apparatus-type information, and the information in the control signals COM is as shown in FIG. 16.

In the present example, the apparatus-type information indicates "color printer" and the information in the control signals COM indicates execution of color-image formation. Therefore, the CPU 111 of the main controller 101 selects execution of image formation. Then, under control of the unit controller 102 according to commands from the main controller 101, the printer 10 carries out the operations described in the section of "Example of operation of image forming apparatus <Forming color images>" above. In this way, a color image is formed on the medium (step S310). At this time, the main controller 101 returns, to the computer 702, a control signal COM indicating that image formation is going to be executed (step S312).

The user interface processing section 805 of the computer 702 receives the control signal COM and interprets its contents. Then, it gives out a command to the display interface section 801 to display a message indicating that image formation will be executed. Receiving this command, the display interface section 801 displays, on the display device 704, a message indicating that image formation will be executed (step S314).

Switching from Color Printer to Monochrome Printer

Figure 17:
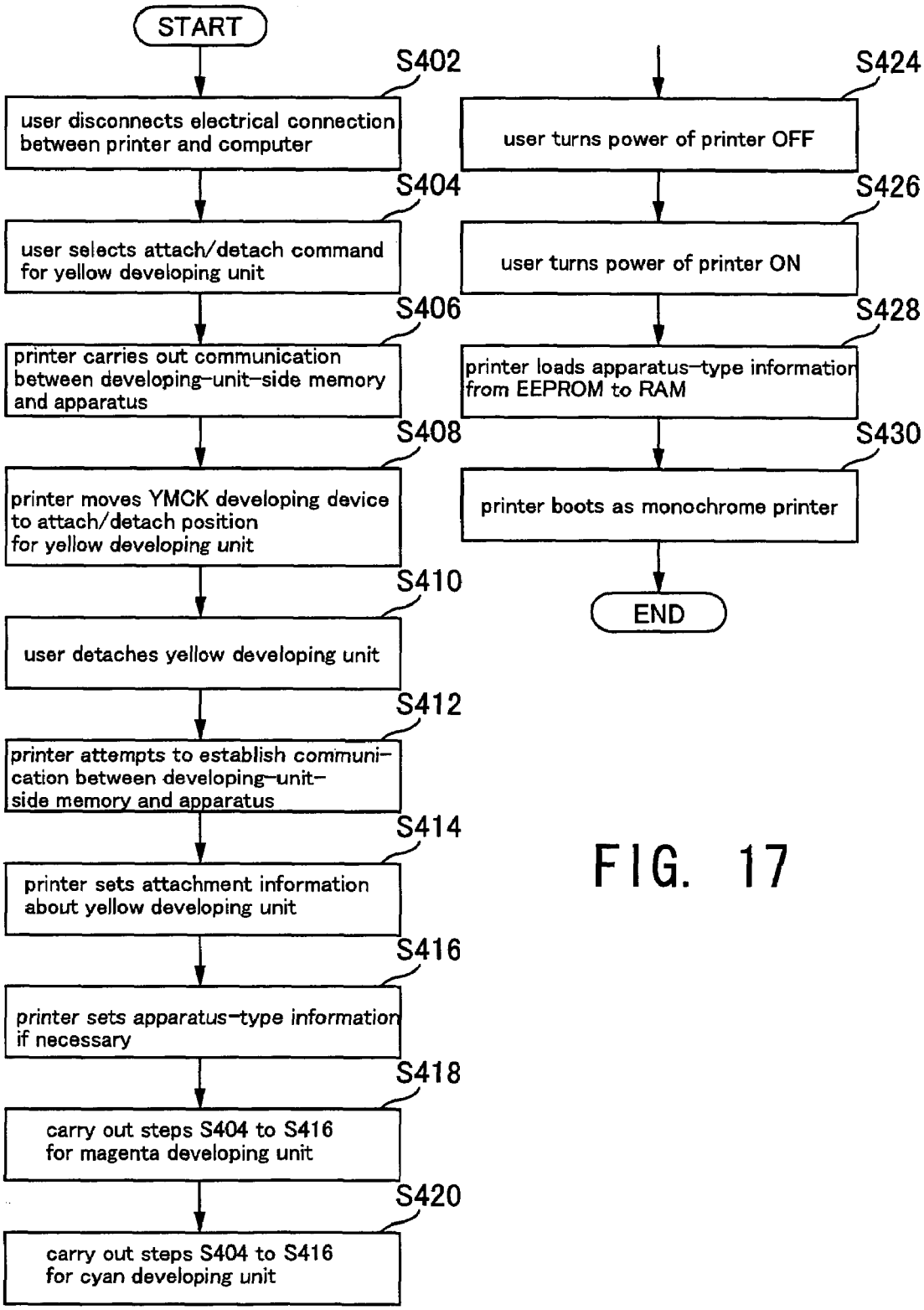
FIG. 17 is a flowchart for illustrating a procedure for switching the printer 10 from a color printer to a monochrome printer.

Next, switching of the printer 10 from a color printer to a monochrome printer will be described using FIG. 17. FIG. 17 is a flowchart for illustrating the procedure for switching the printer 10 from a color printer to a monochrome printer.

This flowchart starts from a state in which the power of the printer 10 has already been turned ON and the printer 10 is on standby for image formation to be carried out. The standby position of the YMCK developing device 50 at this time is the HP position shown in FIG. 8A.

Further, the printer 10, before switching is performed, is used as a color printer, and therefore, the developing units are attached to all four attach/detach sections, as shown in FIG. 3. That is, the black developing unit 51 is attached to the attach/detach section 50*a*, the magenta developing unit 52 is attached to the attach/detach section 50*b*, the cyan developing unit 53 is attached to the attach/detach section 50*c*, and the yellow developing unit 54 is attached to the attach/detach section 50*d*.

First, if the printer 10 is electrically connected to a computer, then the user disconnects the electrical connection by turning the power of the computer OFF, disconnecting the cable that connects the printer 10 and the computer, and so forth (step S402.)

Then, the user operates a menu button provided, for example, on the displaying unit 95, and by selecting the attach/detach command for a certain developing unit, the user gives an instruction to the printer 10 that he/she wishes to attach or detach a developing unit. At the time of giving this instruction, the user designates the developing unit that is targeted for attachment/detachment.

In the present embodiment, the user first selects the attach/detach command for the yellow developing unit 54 (step S404). The unit controller 102 comprehends this command with the displaying unit drive control circuit. More specifically, the unit controller 102 determines which, among the black developing unit 51, the magenta developing unit 52, the cyan developing unit 53, and the yellow developing unit 54, is the developing unit targeted for attachment/detachment. In the present embodiment, the developing unit targeted for attachment/detachment is the yellow developing unit 54. Therefore, the unit controller 102 rotates the pulse motor for a predetermined number of pulses to rotate the YMCK developing device 50 and to move the position of the YMCK developing device 50 from the HP position to the connector attach/detach position for the yellow developing unit 54.

Then, the unit controller 102 halts the YMCK developing device 50 at the connector attach/detach position. In this halted state, the unit controller 102 moves the apparatus-side connector 34 and makes the apparatus-side connector 34 and the developing-unit-side connector 54*b* of the yellow developing unit 54 abut against each other. In this state, the developing-unit-side memory 54*a* of the yellow developing unit 54 is electrically connected to the unit controller 102 of the control unit 100, and communication is established between the developing-unit-side memory 54*a* and the apparatus body (step S406).

After finishing the communication and separating the apparatus-side connector 34 from the developing-unit-side connector 54*b*, the unit controller 102 rotates the pulse motor for a predetermined number of pulses to rotate the YMCK developing device 50 and to move the position of the YMCK developing device 50 from the connector attach/detach position for the yellow developing unit 54 to the attach/detach position for the yellow developing unit 54 (step S408).

In this state, the unit controller 102 notifies the user that the yellow developing unit 54 can be detached from (or attached to) the attach/detach section by displaying a message on the displaying section etc. provided in the displaying unit 95.

Confirming the display, the user opens the outer cover of the printer 10 and detaches the yellow developing unit 54, which is arranged inside the attach/detach dedicated opening 37, from the YMCK developing device 50 through the attach/detach dedicated opening 37 (step S410). After the user detaches the yellow developing unit 54 and closes the outer cover of the printer 10, the unit controller 102 detects this and moves the position of the YMCK developing device 50 from the attach/detach position for the yellow developing unit 54 to the connector attach/detach position for the yellow developing unit 54.

Then, the unit controller 102 halts the YMCK developing device 50 at the connector attach/detach position. In this halted state, the unit controller 102 moves the apparatus-side connector 34 and attempts to establish communication with the developing-unit-side memory of the developing unit (step S412). If communication succeeds, then the unit controller 102 assumes that the yellow developing unit 54 is attached, and sets the attachment information for the yellow developing unit 54 in the EEPROM 116*a* to "1". On the other hand, if communication fails, then the unit controller 102 assumes that the yellow developing unit 54 is not attached, and sets the attachment information for the yellow developing unit 54 in the EEPROM 116*a* to "0" (step S414). In the present embodiment, since the yellow developing unit 54 has been detached at step S410, it is assumed that the communication has failed, and the attachment information for the yellow developing unit 54 in the EEPROM 116*a* is changed from "1" to "0".

After finishing the above-described processes relating to the attachment information, the unit controller 102 sends the attachment information for all four developing units to the main controller 101. The main controller 101 receives the attachment information and sets the above-described apparatus-type information based on the attachment information (step S416).

An algorithm according to which the main controller 101 sets the apparatus-type information based on the attachment information of the four developing units is described below.

If the value of only one of the four pieces of attachment information is "1", which indicates that a developing unit is attached, then the main controller 101 sets the value of the apparatus-type information in the EEPROM 114*a* to "1", which indicates that the printer is to be used as a monochrome printer. On the other hand, if the value of two or more pieces of attachment information is "1", then the main controller 101 sets the value of the apparatus-type information to "0", which indicates that the printer is to be used as a color printer. In both cases, however, if the value of the attachment information for the black developing unit 51 is "0", then the main controller 101 does not execute the operation of setting the apparatus-type information. (That is, if the black developing unit 51, which should be attached regardless of whether the printer is to be used as a color printer or as a monochrome printer, is not attached, the apparatus-type information is not rewritten and the value of the apparatus-type information is kept the same.) The relationship between the values of the attachment information and the operations of setting the apparatus-type information is as shown in FIG. 18.

In the present embodiment, the value of the attachment information only for the yellow developing unit 54 is "0" (and this situation matches case "P" of FIG. 18). Therefore, the main controller 101 sets the value of the apparatus-type information to "0", which indicates "color printer", in accordance with the algorithm described above. In this example, however, the value of the apparatus-type information is not changed because before detachment of the yellow developing unit 54, all four developing units were attached and the value of the apparatus-type information was "0" (the situation for case "Q" of FIG. 18).

Next, the processes from step S404 through step S416 described above are carried out for the cyan developing unit 53 and the magenta developing unit 52 (step S418 and step S420). As a result of carrying out these processes, the values of the attachment information for the cyan developing unit 53 and the magenta developing unit 52 are rewritten from "1" to "0". The values of the attachment information of the developing units received by the main controller 101 become "1" for the black developing unit, "0" for the magenta developing unit, "0" for the cyan developing unit, and "0" for the yellow developing unit (i.e., the values match case "I" of FIG. 18). Therefore, the main controller 101 changes the value of the apparatus-type information from "0", which indicates "color printer", to "1", which indicates "monochrome printer", in accordance with the algorithm described above.

Next, the user temporarily halts power supply to the printer by turning the power of the printer 10 OFF, for example (step S424). The user then supplies power to the printer again by turning the power of the printer 10 ON, for example (step S426).

When power is supplied to the printer 10, the main controller 101 detects this and loads the apparatus-type information from the EEPROM 114*a* to the RAM 114*b* (step S428). Here, the value "1", which indicates "monochrome printer", is loaded to the RAM 114*b*. The CPU 120 of the unit controller 102 then controls the drive control circuits based on the apparatus-type information that has been loaded to the RAM 114*b*. More specifically, as a result of referencing the apparatus-type information in the RAM 114*b*, the printer 10 boots as a monochrome printer, and the units and the YMCK developing device 50 of the printer 10 are controlled to function as a monochrome printer (step S430).

As described above, switching of the printer 10 from a color printer to a monochrome printer is executed when: the state of the printer 10 changes from a state where developing units are attached to at least two of the four attach/detach sections to a state where a developing unit is attached only to the attach/detach section 50*a* by detaching developing units from attach/detach sections other than the attach/detach section 50*a* while power is being supplied to the printer 10; and the power supply to the printer 10 is once stopped and then started again.

In other words, the apparatus-type information will not be loaded from the EEPROM 114*a* to the RAM 114*b* only by changing the state of the printer 10 from a state where developing units are attached to at least two of the four attach/detach sections to a state where a developing unit is attached only to the attach/detach section 50*a*. Therefore, in this case, the value of the apparatus-type information in the RAM 114*b* remains the same as that before the change in state (i.e., the value remains at "0" indicative of "color printer"), and the printer 10 will not switch from the color printer to the monochrome printer. The apparatus-type information is loaded to the RAM 114*b* only after power is supplied again to the printer 10 at step S426, and in this case, the printer 10 refers to the apparatus-type information in the RAM 114*b* and boots as a monochrome printer.

It should be noted that in the present example, it is possible to detach developing units from attach/detach sections other than the attach/detach section 50*a*, in order to change the state of the printer 10 from a state where developing units are attached to at least two attach/detach sections to a state where a developing unit is attached only to the attach/detach section 50*a*, only when power is being supplied to the printer 10.

Figure 19:
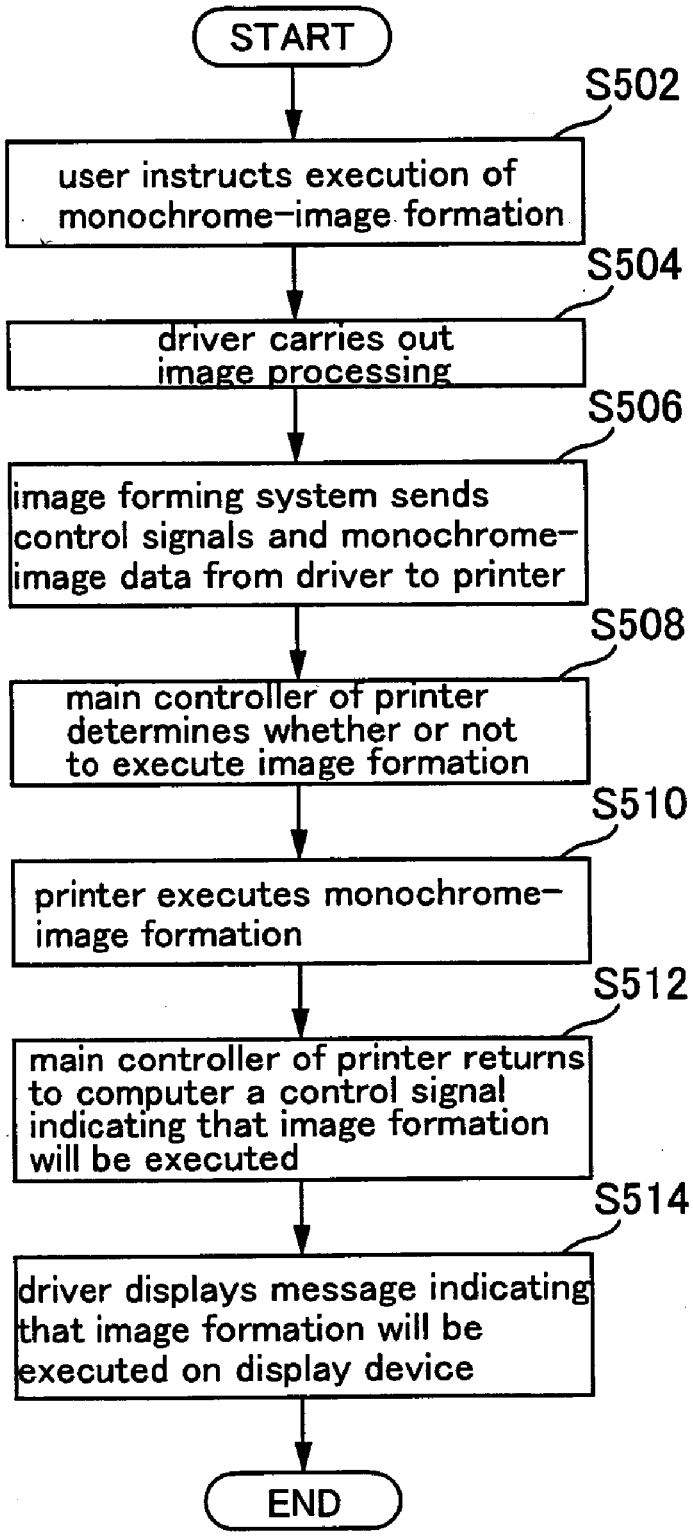
FIG. 19 is a flowchart for illustrating operations of the image forming system 700 for when a user gives instructions to perform monochrome-image formation in a state where the printer 10 is being used as a monochrome printer.

Operations of the Image Forming System for When a User Gives Instructions to Execute Monochrome-Image Formation in a State Where the Printer 10 is Being Used as a Monochrome Printer Next, operations of the image forming system 700 for when a user gives instructions to execute monochrome-image formation in a state where the printer 10 is being used as a monochrome printer is described using FIG. 19. FIG. 19 is a flowchart for illustrating operations of the image forming system 700 for when a user gives instructions to perform monochrome-image formation in a state where the printer 10 is being used as a monochrome printer.

This flowchart starts from a state in which the power of the printer 10 and the computer 702 has already been turned ON and the system is on standby for execution of image formation. Further, since the printer 10 is being used as a monochrome printer, only one developing unit is attached to one of the four attach/detach sections, as shown in FIG. 4. That is, the black developing unit 51 is attached to the attach/detach section 50*a*, whereas no developing unit is attached to the other attach/detach sections 50*b*, 50*c*, and 50*d*.

First, the user operates the above-described application program 795 to give instructions to the image forming system 700 to execute image formation (step S502). According to these instructions, image data AD in the application program is transferred from the application program 795 to the image-processing section 797 of the printer driver 796. At this time, the user also enters information about the quality of the image to be formed using the input device 708 through the user interface window displayed on the display device 704 by the display interface section 801 of the printer driver 796.

Figure 21:
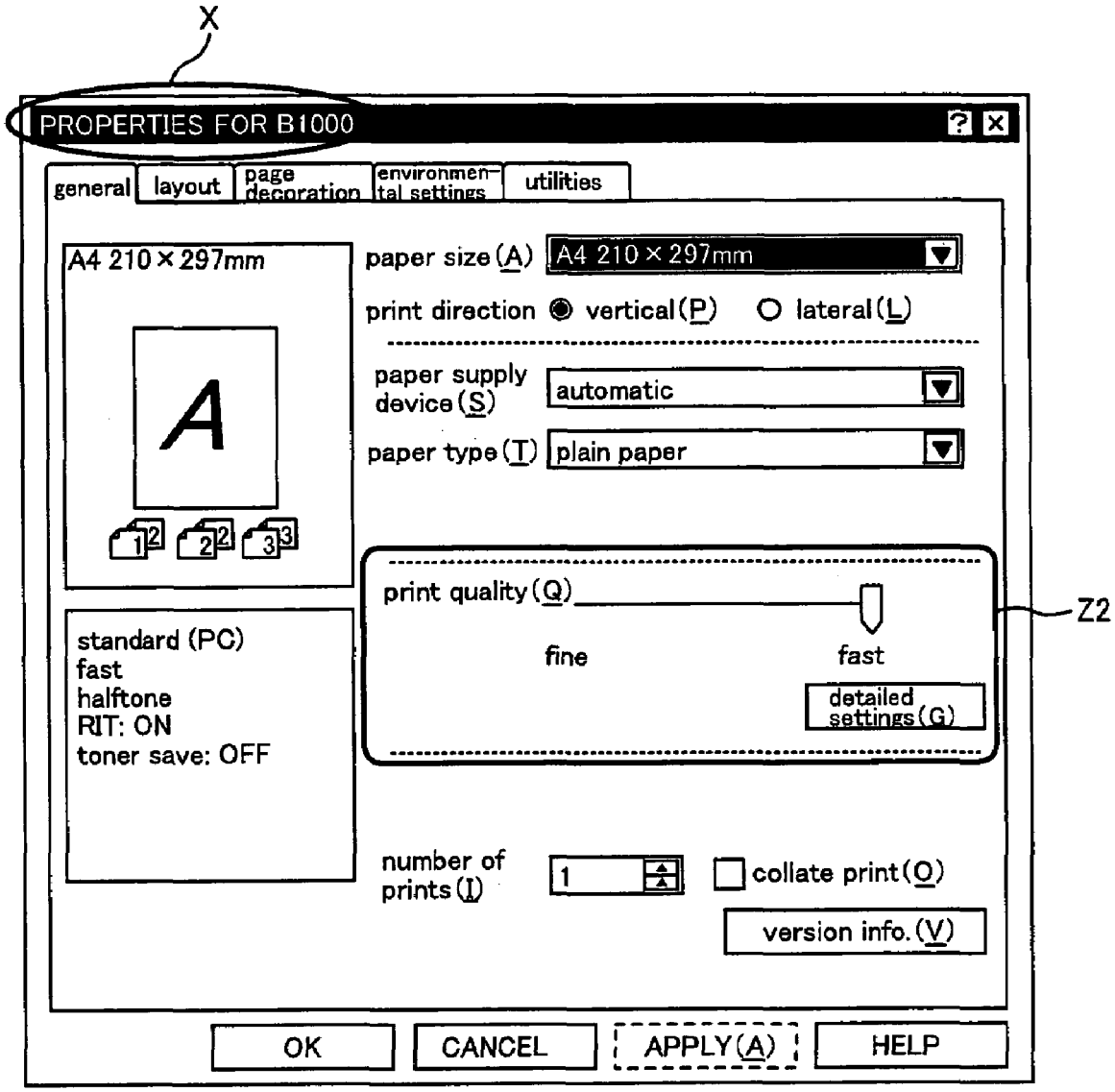
FIG. 21 is a diagram showing an example of a user interface window displayed by a monochrome driver on the display device 704.

The user interface window is described below using FIG. 21. FIG. 21 is a diagram showing an example of a user interface window displayed on the display device 704 by the monochrome driver. In FIG. 21, the apparatus-type name of the printer 10 is displayed in the section marked with "X2". The apparatus-type name differs for when the printer 10 is being used as a color printer and for when it is being used as a monochrome printer. In the present example, the apparatus-type name for the former case is "C1000", whereas the apparatus-type name for the latter case is "B1000". Further, in the present example, since the printer 10 is being used as a monochrome printer, the apparatus-type name "B1000" is displayed on the user interface window. As it is clear from FIG. 20 and FIG. 21, the apparatus-type name displayed on the user interface window of the display device 704 for when the printer 10 is being used as a monochrome printer is different from (i.e., is not the same as) the apparatus-type name displayed on the user interface window of the display device 704 for when the printer 10 is being used as a color printer.

Further, in FIG. 21, information for making the user set the quality of the image to be formed is displayed in the section marked with "Z2". The user can set the level of image quality through operation of the mouse. In addition to this, it is also possible to make further detailed settings. As it is clear from FIG. 20 and FIG. 21, the information for making the user set the quality of the image to be formed, which is displayed on the user interface window of the display device 704, for when the printer 10 is being used as a monochrome printer is different from (i.e., is not the same as) the information which is displayed on the user interface window of the display device 704 for when the printer 10 is being used as a color printer.

It should be noted that in the present example, the information for making the user select either execution of color-image formation or execution of monochrome-image formation is not displayed, because the printer driver 796 is a monochrome driver. In other words, information specific to a color printer is displayed on the user interface window of the display device 704 when the printer 10 is being used as a color printer, but it is not displayed on the user interface window of the display device 704 when the printer 10 is being used as a monochrome printer. The user interface processing section 805 sends the information indicating execution of monochrome-image formation to the printer 10 and the image processing section 797 as control signals COM, even when the information indicating execution of monochrome-image formation is not entered.

As described above, the information displayed on the display device 704 for when the printer 10 is being used as a monochrome printer is different from (i.e., is not the same as) the information displayed on the display device 704 for when the printer 10 is being used as a color printer. In this way, it is possible to display, on the display device 704, appropriate information that suits the printer 10 respectively for when it is being used as a monochrome printer and for when it is being used as a color printer.

The input interface section 803 of the printer driver 796 that has received the information indicative of the quality of the image to be formed sends the information to the user interface processing section 805. The user interface processing section 805 processes the received information, and sends the information to the image processing section 797 as control signals COM.

The image processing section 797 receives, as control signals COM, the information indicative of execution of monochrome-image formation, as well as the information indicative of the quality of the image to be formed, and based on this information, it processes the image data AD that it received from the application program 795 (step S504). That is, image processing for carrying out monochrome-image formation is executed by the image processing section 797. After the image processing is finished, monochrome-image data PD, which have been obtained by the processing, are sent to the printer 10.

Finally, the control signals COM, which are indicative of execution of monochrome-image formation, and the monochrome-image data PD are sent from the printer driver 796 to the printer 10 (step S506). Through these operations, the printer driver 796 instructs the printer 10 to carry out image formation.

The printer 10 receives the monochrome-image data PD and the control signals COM, which are indicative of execution of monochrome-image formation, from the computer 702 via the interface (I/F) 112. The printer 10 temporarily stores the received monochrome-image data PD in the image memory 113 of the main controller 101. The CPU 111 of the main controller 101 then determines whether image formation is to be executed or not according to the criterion for determination shown in FIG. 16 (step S508).

In the present example, the apparatus-type information indicates "monochrome printer" and the information in the control signals COM indicates execution of monochrome-image formation. Therefore, the CPU 111 of the main controller 101 selects execution of image formation. Then, under control of the unit controller 102 according to commands from the main controller 101, the printer 10 carries out the operations described in the section of "Example of operation of image forming apparatus <Forming monochrome images>" above. In this way, a monochrome image is formed on the medium (step S510). At this time, the main controller 101 returns, to the computer 702, a control signal COM indicating that image formation is going to be executed (step S512).

The user interface processing section 805 of the computer 702 receives the control signal COM and interprets its contents. Then, it gives out a command to the display interface section 801 to display a message indicating that image formation will be executed. Receiving this command, the display interface section 801 displays, on the display device 704, a message indicating that image formation will be executed (step S514).

In the image forming system described above, the driver for instructing the printer to execute image formation when the printer is being used as a color printer is different from the driver for instructing the printer to execute image formation when the printer is being used as a single-color printer. In this way, it is possible to achieve an image forming system that is convenient for users.

That is, as described in the section of the "Description of the Related Art" etc., users are supplied with drivers that are capable of instructing printers of the type described above to execute image formation. It may be disadvantageous for the user, however, if the same driver is used as the driver for instructing the printer to execute image formation when it is being used as a color printer, and as the driver for instructing the printer to execute image formation when it is being used as a single-color printer. For example, if the driver is capable of being commonly used for instructing both color-image formation and single-color-image formation, then, in cases where the user instructs execution of color-image formation when the printer is being used as a single-color printer, the driver will instruct the printer, which is being used as a single-color printer, to form color images. As a result, contrary to the user's intentions, the user may not be able to obtain the images that he/she wishes. On the contrary, if a driver is capable of instructing execution of only single-color-image formation, then the driver could only instruct the printer to form single-color images, even when it is being used as a color printer.

In view of the above, the system according to the present example is configured such that the driver for instructing the printer to execute image formation when the printer is being used as a color printer is different from the driver for instructing the printer to execute image formation when the printer is being used as a single-color printer. In this way, a color driver adjusted for color printers can be used when the printer is being used as a color printer, whereas a single-color driver adjusted for single-color printers can be used when the printer is being used as a single-color printer. Therefore, it is possible to overcome the disadvantages of the user.

More specifically, by using a single-color driver that is capable of instructing execution of only single-color-image formation when the printer is being used as a single-color printer, it becomes possible to avoid the inconvenience caused by the driver instructing execution of color-image formation to a printer that is being used as a single-color printer. Further, by using a color driver that is capable of instructing execution of both color-image formation and single-color-image formation when the printer is being used as a color printer, it becomes possible to avoid the problem in that the driver is only able to instruct the printer to form single-color images though it is being used as a color printer.

Consequently, it becomes possible to achieve an image forming system that is convenient for users.

The description above was about the operations of the image forming system for when (1) a user gave instructions to execute color-image formation when the printer was being used as a color printer, (2) the printer was then switched from a color printer to a monochrome printer, and (3) the user gave instructions to execute monochrome-image formation when the printer was being used as a monochrome printer. It should be noted, however, that the same effects can be obtained even for cases where (1) a user gives instructions to execute monochrome-image formation when the printer is being used as a monochrome printer, (2) the printer is then switched from a monochrome printer to a color printer, and (3) the user gives instructions to execute color-image formation when the printer is being used as a color printer.

Other Considerations

In the foregoing example, an image forming system having a printer that is usable as a color printer or a single-color printer, and a computer that is capable of communicating with the printer and that has at least one printer driver capable of instructing the printer to execute image formation was described. In this image forming system, the driver for instructing the printer to execute image formation when the printer was being used as the color printer was different from the driver for instructing the printer to execute image formation when the printer was being used as the single-color printer.

However, it is also possible to achieve an image forming system having a printer that is usable as a color printer or a single-color printer, and a computer that is capable of communicating with the printer, wherein: the computer is provided with a color driver that is capable of instructing the printer to execute image formation when the printer is being used as the color printer and a single-color driver that is capable of instructing the printer to execute image formation when the printer is being used as the single-color printer; when the printer is being used as the color printer, the color driver instructs the printer to execute image formation; and when the printer is being used as the single-color printer, the single-color driver instructs the printer to execute image formation.

Even with this type of image forming system, the above-described effect, i.e., the effect that it is possible to achieve an image forming system convenient for users, can be obtained.

Further, in the foregoing example, the computer had a display device for displaying information thereon; each printer driver was capable of displaying information on the display device; and the printer driver for displaying the information on the display device for when the printer was being used as the color printer was different from the printer driver for displaying the information on the display device for when the printer was being used as the single-color printer. This, however, is not a limitation. Further, the information displayed on the display device when the printer was being used as the color printer was different from (i.e., was not the same as) the information displayed on the display device when the printer was being used as the single-color printer. This, however, is not a limitation.

The foregoing example, however, is more preferable in terms that it becomes possible to display, on the display device, appropriate information that suits the printer respectively for when it is being used as a single-color printer and for when its is being used as a color printer.

Further, in the foregoing example, examples for when the information displayed on the display device when the printer was being used as the color printer was different from the information displayed on the display device when the printer was being used as the single-color printer were:

when the information was about the apparatus-type name of the printer;

when the information concerned information for making the user set the quality of the image to be formed; and where information specific to the color printer was displayed on the display device when the printer was being used as the color printer, but such information was not displayed on the display device when the printer was being used as the single-color printer. These, however, are not limitations.

The foregoing example, however, is more preferable in terms that, if the information is about the apparatus-type name of the printer, the user can easily acknowledge whether the printer is being used as a single-color printer or as a color printer. Further, the foregoing example is more preferable in terms that, if the information concerns information for making the user set the quality of the image to be formed, the user can appropriately set the image quality according to whether the printer is being used as a single-color printer or as a color printer. Further, the foregoing example is more preferable in terms that, by displaying information specific to the color printer on the display device when the printer is being used as the color printer, but not displaying such information on the display device when the printer was being used as the single-color printer, it is possible to display, on the display device, the information specific to a color printer only when necessary.

Other Embodiments

In the foregoing, an image forming system etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

It should be noted that in the foregoing embodiment, a configuration of a system in which the printer is connected directly to the computer, as shown in FIG. 1, was described. The printer, however, may be connected to the computer via a network.

Further, in the foregoing embodiment, the computer was described to include a display device such as a CRT (Cathode Ray Tube), a liquid crystal display device, or a plasma display, an input device such as a keyboard and a mouse, a reading device such as an FD (Flexible Disk) device, a CD-ROM drive device, an MO (Magneto Optical) disk drive device, and a DVD (Digital Versatile Disk) device, an internal memory such as a RAM, and an external memory such as a hard disk drive unit. This, however, is not a limitation, and some of the devices described above do not have to be provided. Further, for example, the printer may have some of the functions and/or mechanisms of the computer.

Further, in the foregoing embodiment, an intermediate transferring type laser beam printer was described as an example of the image forming apparatus, but the present invention is also applicable to various other types of image forming apparatuses, such as laser beam printers that are not of the intermediate transferring type, copying machines, and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

Further, in the foregoing embodiment, communication between the developing-unit-side memories and the main body of the apparatus was carried out by making the apparatus-side connector abut against the developing-unit-side connectors. This, however, is not a limitation. Communication may be achieved without making the members of the developing units and a member of the main body of the apparatus coming into contact with each other.

Further, the photoconductor is not limited to a so-called photoconductive roller having a structure in which a photoconductive layer is provided on the outer peripheral surface of a cylindrical, conductive base. The photoconductor can be a so-called photoconductive belt structured by providing a photoconductive layer on a surface of a belt-like conductive base, for example.

Further, in the foregoing embodiment, the single-color printer was a monochrome printer that forms monochrome images, when a developing unit is attached to only one of the plurality of attach/detach sections, by developing the latent image bore on the photoconductor with the toner contained in the developing unit, but this is not a limitation. More specifically, in the foregoing embodiment, the developing unit attached to the one attach/detach section was a black developing unit, and monochrome images were formed by developing the latent image with the toner contained in the black developing unit, but this is not a limitation. The developing unit attached to that one attach/detach section may be a developing unit having toner of another color, and images in that color may be formed by developing the latent image with the toner contained in that developing unit.

Further, in the foregoing embodiment, power supply to the printer was stopped and started again by turning the power of the printer ON and OFF. This, however, is not a limitation. For example, this can be achieved by resetting the printer.

What is claimed is:

1. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus and that has a driver capable of instructing said image forming apparatus to execute at least either single-color-image formation or color-image formation, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

a switching of said image forming apparatus between said color image forming apparatus and said single-color-image forming apparatus is executed when a power supply to said image forming apparatus is stopped and then started again;

said image forming apparatus forms an image when said driver instructs said image forming apparatus that is being used as said color image forming apparatus to execute said single-color-image formation; and said image forming apparatus does not form an image when said driver instructs said image forming apparatus that is being used as said single-color image forming apparatus to execute said color-image formation.

2. An image forming system according to claim 1, wherein said image forming apparatus has information indicative of whether said image forming apparatus is being used as said color image forming apparatus or whether said image forming apparatus is being used as said single-color image forming apparatus.

3. An image forming system according to claim 1, wherein said single-color image forming apparatus is a monochrome image forming apparatus that forms monochrome images, when a developer container is attached to only one of said plurality of attach/detach sections, by developing the latent image bore on said image bearing body with the developer contained in said developer container.

4. An image forming system according to claim 1, wherein said driver is capable of instructing said image forming apparatus to execute said color-image formation and said single-color-image formation.

5. An image forming system according to claim 1, wherein when said driver instructs said image forming apparatus that is being used as said single-color image forming apparatus to execute said color-image formation, said image forming system makes a notification to the effect that an image will not be formed.

6. An image forming system according to claim 5, wherein when said driver instructs said image forming apparatus that is being used as said single-color image forming apparatus to execute said color-image formation, said image forming system displays a notification to the effect that an image will not be formed.

7. An image forming system according to claim 6, wherein:

said computer further comprises a displaying section for displaying information thereon; and when said driver instructs said image forming apparatus that is being used as said single-color image forming apparatus to execute said color-image formation, said image forming system displays, on said displaying section, the notification to the effect that an image will not be formed.

8. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus and that has a driver capable of instructing said image forming apparatus to execute at least either single-color-image formation or color-image formation, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image-forming apparatus for forming a single-color image by developing the latent image bore on said image bearing body with the developer contained in said developer container;

a switching of said image forming apparatus between said color image forming apparatus and said single-color-image forming apparatus is executed when a power supply to said image forming apparatus is stopped and then started again;

said image forming apparatus forms an image when said driver instructs said image forming apparatus that is being used as said color image forming apparatus to execute said single-color-image formation;

said image forming apparatus does not form an image when said driver instructs said image forming apparatus that is being used as said single-color image forming apparatus to execute said color-image formation;

said image forming apparatus has information indicative of whether said image forming apparatus is being used as said color image forming apparatus or whether said image forming apparatus is being used as said single-color image forming apparatus;

said single-color image forming apparatus is a monochrome image forming apparatus that forms monochrome images, when a developer container is attached to only one of said plurality of attach/detach sections, by developing the latent image bore on said image bearing body with the developer contained in said developer container;

said driver is capable of instructing said image forming apparatus to execute said color-image formation and said single-color-image formation;

when said driver instructs said image forming apparatus that is being used as said single-color image forming apparatus to execute said color-image formation, said image forming system makes a notification to the effect that an image will not be formed;

said computer further comprises a displaying section for displaying information thereon; and when said driver instructs said image forming apparatus that is being used as said single-color image forming apparatus to execute said color-image formation, said image forming system displays, on said displaying section, the notification to the effect that an image will not be formed.

9. An image forming apparatus comprising:

a plurality of attach/detach sections to and from each of which a developer container for containing developer can be attached and detached; and an image bearing body for bearing a latent image, wherein: when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

a switching of said image forming apparatus between said color image forming apparatus and said single-color-image forming apparatus is executed when a power supply to said image forming apparatus is stopped and then started again;

in a state where said image forming apparatus is being used as said color image forming apparatus, said image forming apparatus forms an image when said image forming apparatus receives, from a computer, an instruction to execute single-color-image formation; and in a state where said image forming apparatus is being used as said single-color image forming apparatus, said image forming apparatus does not form an image when said image forming apparatus receives, from a computer, an instruction to execute color-image formation.

10. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus and that has at least one driver capable of instructing said image forming apparatus to execute image formation, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

a switching of said image forming apparatus between said color image forming apparatus and said single-color-image forming apparatus is executed when a power supply to said image forming apparatus is stopped and then started again; and a driver for instructing said image forming apparatus to execute said image formation when said image forming apparatus is being used as said color image forming apparatus is different from a driver for instructing said image forming apparatus to execute said image formation when said image forming apparatus is being used as said single-color image forming apparatus.

11. An image forming system according to claim 10, wherein said image forming apparatus has information indicative of whether said image forming apparatus is being used as said color image forming apparatus or whether said image forming apparatus is being used as said single-color image forming apparatus.

12. An image forming system according to claim 10, wherein said single-color image forming apparatus is a monochrome image forming apparatus that forms monochrome images, when a developer container is attached to only one of said plurality of attach/detach sections, by developing the latent image bore on said image bearing body with the developer contained in said developer container.

13. An image forming system according to claim 10, wherein:

said computer further comprises a displaying section for displaying information thereon;

each said driver is capable of displaying information on said displaying section; and a driver for displaying the information on said displaying section for when said image forming apparatus is being used as said color image forming apparatus is different from a driver for displaying the information on said displaying section for when said image forming apparatus is being used as said single-color image forming apparatus.

14. An image forming system according to claim 13, wherein said information that is displayed on said displaying section when said image forming apparatus is being used as said color image forming apparatus is different from said information that is displayed on said displaying section when said image forming apparatus is being used as said single-color image forming apparatus.

15. An image forming system according to claim 14, wherein said information is an apparatus-type name of said image forming apparatus.

16. An image forming system according to claim 14, wherein said information is information for making a user set a quality of the image to be formed.

17. An image forming system according to claim 14, wherein:

information specific to said color image forming apparatus is displayed on said displaying section when said image forming apparatus is being used as said color image forming apparatus; and said information specific to said color image forming apparatus is not displayed on said displaying section when said image forming apparatus is being used as said single-color image forming apparatus.

18. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus and that has at least one driver capable of instructing said image forming apparatus to execute image formation, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

a switching of said image forming apparatus between said color image forming apparatus and said single-color-image forming apparatus is executed when a power supply to said image forming apparatus is stopped and then started again;

a driver for instructing said image forming apparatus to execute said image formation when said image forming apparatus is being used as said color image forming apparatus is different from a driver for instructing said image forming apparatus to execute said image formation when said image forming apparatus is being used as said single-color image forming apparatus;

said image forming apparatus has information indicative of whether said image forming apparatus is being used as said color image forming apparatus or whether said image forming apparatus is being used as said single-color image forming apparatus;

said single-color image forming apparatus is a monochrome image forming apparatus that forms monochrome images, when a developer container is attached to only one of said plurality of attach/detach sections, by developing the latent image bore on said image bearing body with the developer contained in said developer container;

said computer further comprises a displaying section for displaying information thereon;

each said driver is capable of displaying information on said displaying section;

a driver for displaying the information on said displaying section for when said image forming apparatus is being used as said color image forming apparatus is different from a driver for displaying the information on said displaying section for when said image forming apparatus is being used as said single-color image forming apparatus;

said information that is displayed on said displaying section when said image forming apparatus is being used as said color image forming apparatus is different from said information that is displayed on said displaying section when said image forming apparatus is being used as said single-color image forming apparatus;

said information is an apparatus-type name of said image forming apparatus;

said information is information for making a user set a quality of the image to be formed;

information specific to said color image forming apparatus is displayed on said displaying section when said image forming apparatus is being used as said color image forming apparatus; and said information specific to said color image forming apparatus is not displayed on said displaying section when said image forming apparatus is being used as said single-color image forming apparatus.

19. An image forming system comprising:

an image forming apparatus that includes a plurality of attach/detach sections to and from each of which a developer container for containing developer can be attached and detached and an image bearing body for bearing a latent image; and a computer that is capable of communicating with said image forming apparatus, wherein:

when a developer container is attached to each of said plurality of attach/detach sections, said image forming apparatus is usable as a color image forming apparatus for forming a color image by developing the latent image bore on said image bearing body with the developer contained in each said developer container;

when a developer container is attached to only one of said plurality of attach/detach sections, said image forming apparatus is usable as a single-color image forming apparatus for forming a single-color image by developing the latent image bore on said image bearing body with the developer contained in said developer container;

a switching of said image forming apparatus between said color image forming apparatus and said single-color-image forming apparatus is executed when a power supply to said image forming apparatus is stopped and then started again;

said computer has a color driver that is capable of instructing said image forming apparatus to execute image formation when said image forming apparatus is being used as said color image forming apparatus and a single-color driver that is capable of instructing said image forming apparatus to execute image formation when said image forming apparatus is being used as said single-color image forming apparatus;

when said image forming apparatus is being used as said color image forming apparatus, said color driver instructs said image forming apparatus to execute said image formation; and when said image forming apparatus is being used as said single-color image forming apparatus, said single-color driver instructs said image forming apparatus to execute said image formation.

* * * * *